United States Patent [19]

Babcock et al.

[11] 3,984,249

[45] Oct. 5, 1976

[54] PROCESS FOR SENSITIZING PHOTOSENSITIVE SILVER HALIDE MATERIALS WITH HYDROGEN

[75] Inventors: Thomas A. Babcock; William C. Lewis; Thomas H. James, all of Rochester, N.Y.

[73] Assignee: Eastman Kodak Company, Rochester, N.Y.

[22] Filed: Feb. 4, 1975

[21] Appl. No.: 546,964

Related U.S. Application Data

[63] Continuation of Ser. No. 328,580, Feb. 1, 1973, abandoned, which is a continuation-in-part of Ser. No. 174,508, Aug. 24, 1971, abandoned, which is a continuation of Ser. No. 70,465, Sept. 8, 1970, abandoned.

[52] U.S. Cl. ..... 96/100; 96/94 R; 96/107; 96/108; 96/120

[51] Int. Cl.[2] ..... G03C 1/28

[58] Field of Search ..... 96/107, 108, 94 R, 120, 96/100

[56] References Cited

UNITED STATES PATENTS 3,542,557 11/1970 Illingsworth et al. ..... 96/107

OTHER PUBLICATIONS

Shin–Piaw: "Journal of the Optical Society of America", vol. 34, May, 1944, pp. 285–289.

James: "Some Effects of Enviornment on Latent Image Formation by Light", in Photographic Science and Engineering, Jan.–Feb., 1970, pp. 84–96.

*Primary Examiner*—Won H. Louie, Jr.

*Attorney, Agent, or Firm*—Carl O. Thomas

[57] ABSTRACT

A process is disclosed for increasing the sensitivity of negative-forming radiation sensitive silver halide layers by treating such silver halide layers with hydrogen. The layers thus treated manifest a reduced or substantial absence of reciprocity law failure as well as increased sensitivity to electromagnetic radiation. The products so treated can contain spectral and chemical sensitizers and/or color forming dye-couplers and/or other suitable addenda conventionally employed with photosensitive elements. The products can also exhibit the ability to increase still further in photosensitivity even after imagewise exposure thereof upon prolonged storage of the exposed products under ambient conditions before they are developed.

27 Claims, No Drawings

PROCESS FOR SENSITIZING PHOTOSENSITIVE SILVER HALIDE MATERIALS WITH HYDROGEN

This is a continuation of application Ser. No. 328,580, filed Feb. 1, 1973, now abandoned. Said application Ser. No. 328,580 is a continuation-in-part of U.S. application Ser. No. 174,508, filed Aug. 24, 1971, now abandoned which in turn was a continuing application of U.S. Ser. No. 70,465, filed Sept. 8, 1970, now abandoned.

BACKGROUND OF THE INVENTION

1. FIELD OF THE INVENTION

This invention relates to photography. In one aspect, the invention relates to a process for increasing the sensitivity of photosensitive silver halide layers especially silver halide emulsion layers and especially silver halide emulsion layers coated on a support. Products obtained in accordance with the process disclosed herein manifest increased photographic speed and reduced or substantially eliminated reciprocity law failure.

2. DESCRIPTION OF THE PRIOR ART

Various techniques have been disclosed for increasing the speed of silver halide emulsions which are employed in photograhic applications. It is well known, for example that gelatino, photographic silver halide emulsions can be sensitized chemically with a variety of chemical sensitizers. Illustrative of the chemical sensitizers which have been employed are labile sulfur compounds, selenium and tellurium compounds, certain noble metals, so-called reduction sensitizers, or combinations of chemical sensitizers. The chemical sensitizers are described, for example, in U.S. Pat. No. 1,623,499 of Sheppard et al., issued Apr. 5, 1927; U.S. Pat. No. 2,399,083 of Waller et al., issued Apr. 29, 1946; U.S. Pat. No. 3,297,446 of Dunn, issued Jan. 10, 1967 and U.S. Pat. No. 3,442,653 of Dunn, issued May 6, 1969.

Increasing the grain size of silver halides has been employed in order to provide silver halide materials which evidenced increased sensitivity. The application of vacuum treatment for photographic elements have also been employed in order to increase the speed of photographic materials. Vacuum treatment is described in Belgium Pat. No. 734,571 Aug. 14, 1969. In accordance with the Belgium patent, degassing a photographic silver halide emulsion through use of a high vacuum, such as, for example pressures of about $10^{-3}$ torr and exposing the photographic materials in the substantial absence of oxygen and moisture results in some increase in photographic sensitivity of the photographic materials.

The use of pneumatic pressure has been employed as a technique for effecting photographic sensitivities. Journal of the Optical Society of America, Vol. 34, 1944, pages 285–289, "Influence of Pneumatic Pressure on the Photographic Sensitivity" by Choong Shin-Piaw a technique is described whereby photosensitive silver halide emulsion layers are subjected to pneumatic pressure prior to exposure of such layers to actinic radiation. This reference teaches the use of pneumatic pressure applied by hydrogen, nitrogen or carbon dioxide.

It is also known from U.S. Pat. No. 3,542,557 of Illingsworth et al. that the sensitivity of silver halide emulsions can be increased if the liquid, bulk emulsions are subjected to pneumatic pressure prior to such emulsions being coated-out onto supporting surfaces. Illingsworth et al. teach that the pneumatic pressure may be supplied by the use of a wide variety of gases, including nitrogen, carbon dioxide and hydrogenm, as well as inert gases such as neon, helium, argon, krypton and xenon.

While the processes described above have succeeded in enhancing the sensitivity and hence increasing the speed of photosensitive silver halide emulsion layers, they have not succeeded in increasing the speed to the highly unexpected extent described herein. Moreover, such processes have not been successful in eliminating the problem of reciprocity law failure particularly at very low light intensities, such as those, for example, encountered in the field of astronomy, where it is often desired to photograph very faintly luminous objects which are usually far from our planet.

Accordingly there is a need for improved methods for increasing the sensitivity of photosensitive silver salt layers thereby increasing the speed of such silver salt layers and substantially reducing the reciprocity law failure.

It is an object of this invention to increase the inherent photographic speed of photographic elements. It is another object to increase the existing spectral sensitivity of photographic emulsions which have been treated with spectral sensitizers such as one or more spectral sensitizing dyes. It is yet another object of this invention to provide photographic emulsions which exhibit good high contrast. It is still another object of this invention to provide photographic emulsions which do not suffer from reciprocity law failure. It is still another object of this invention to increase the inherent and spectral sensitivity of photographic emulsions without the use of heat or hypersensitizing agents. It is still another object of the invention to increase the sensitivity of photographic emulsions which can be processed through the use of heat.

SUMMARY OF THE INVENTION

In accordance with the invention it has been discovered that the inherent photographic speed of negative-forming radiation sensitive silver salt layers can be increased. It has further been discovered that the speed of chemically sensitized negative-forming radiation sensitive silver salt layers can be significantly increased and that the spectral sensitivity of said radiation sensitive materials spectrally sensitized with a spectrally sensitizing material can be greatly expanded. This increase in speed and spectral sensitivity is obtained while substantially reducing or eliminating reciprocity law failure which generally occurs during long duration and/or short duration exposures. Still further increases in sensitivity of the layers can be achieved by a technique which involves prolonged storage of the layers (preferably at least about 5 days, but as much as 2 months or more can be utilized), under ambient conditions (room air) if desired, after imagewise exposure, but before they are developed. This is surprising in view of the fact that, ordinarily, exposed photographic silver halide-containing layers tend to lose their sensitivity (part of the latent image disappears) when they are stored for a prolonged period of time before they are developed. For example, although photographic lyers which are very carefully handled by a special technique (involving treatment thereof with a high vacuum and subsequently storing and exposing the layer to radiation while maintaining the layer under an inert gas blanket or in a vacuum) seem to exhibit substantially reduced low level reciprocity failure, experiments have shown that the sensitivity of the layers cannot be increased substantially by prolonged storage in room air between exposure and development of the layers. The improvements described are effected by treating a negative-forming radiation sensitive element, which is relatively dry and has had the atmospheric gases substantially removed, with hydrogen. The increased photographic speed is achieved without increasing grain size of the photosensitive silver compound. The hydrogen treatment effects an increase in the so-called inherent sensitivity of photosensitive silver halide together with the spectral sensitivy of said silver halide layers or emulsions containing spectral sensitizers.

The photographic elements that are sensitized by the processes of the present invention can be characterized by (1) their having substantially no reciprocity law failure when they have been exposed to the same quanta of radiation over a range of from about 1 to about 3000 seconds, the quanta being selected to give a developed density of about 0.4 above fog, and (2) their additional valuable ability to exhibit still further increased sensistivity upon prolonged storage (e.g., about 30 days in a test situation) under ambient (room air) conditions after imagewise exposure but before they are developed.

DESCRIPTION OF THE PREFERRED EMBODIMENTS

In accordance with an embodiment of the invention there is provided a process which comprises treating a negative-forming radiation sensistive silver compound containing layer which process comprises substantially reducing the concentration of atmospheric gases and moisture in said layer and treating said layer with hydrogen. Thus, the process comprises two steps: the step of treating the radiation sensitive silver compound containing layer with hydrogen and the step of reducing the concentration of atmospheric gases and moisture from the atmosphere surroundinhg said layer and also from said layer. Generally, it is the equipment used in preparing the radiation sensitive layer which facilitates performing the reduction of the concentration of atmospheric gases and moisture prior to the treatment with hydrogen.

As employed in this specification, as well as in the appended claims, the use of the term "atmosphere" is intended to include the mass of air which generally surrounds a radiation sensitive silver salt emulsion layer or which is contained in said layer. Radiation is intended to include any of the known rays such as for example x-rays, ultraviolet radiation, infrared radiation, actinic radiation as well as electron beams and the like. The term layer is intended to include a silver emulsion coated on a film support, a self supporting silver salt emulsion, and the like. Preferably the silver salt layer is coated on a support. By "negative forming" is meant those photographic elements or layers which can be developed out conventionally to form negative images, the density of which increases with increasing illuminance or with increasing exposure.

The reduction of the concentration of atmospheric gases and moisture which ordinarily surrounds the silver salt layers may be accomplished by any suitable technique or apparatus. For example, the emulsion layers can be placed in a chamber containing inlet and outlet means. A suitable dry inert gas may then be passed through the inlet means and out through the exit means in order to sweep the atmospheric gases and moisture that may be contained within the silver salt layer and in the surrounding atmosphere. Gases such as nitrogen, helium, argon and even hydrogen may be employed. In accordance with a preferred embodiment of the invention the silver salt layers are placed in a suitable chamber which is capable of being evacuated and thereafter filled with hydrogen. A suitable apparatus is a vacuum desiccator or a so-called vacuum sensitometer. A typical vacuum sensitometr is described in Photographic Science and Engineering, Vol. 13, pages 54–64, 1969. The radiation sensitive silver salt emulsion layers (protected from exposing type radiation) can be simply placed in such an apparatus and vacuum applied in order to remove a portion of the original atmosphere surrounding such layers.

In order that the optimum effect be obtained in accordance with this invention it is desirable that the major portion (for example, at least about 70 weight percent, and preferably at least about 90 weight percent) of oxygen and moisture be removed from the atmosphere surrounding the radiation sensistive layers. Vacuum treatment at pressures of from about less than atmosphere pressure to about $10^{-7}$ torr can be employed and preferably vacuum treatment from about 25 torr to about $10^{-7}$ torr is employed. In a preferred embodiment it is most desirable to subject the radiation sensistive layers to vacuum treatment in a range of from about $10^{-3}$ torr to about $10^{-7}$ torr. The time for which the vacuum treatment is maintained can vary over a wide range. The lower the pressure the shorter the time for treatment. However, in order to obtain the maximum effects it is desirable that the treatment should be maintained in order to remove the major portion of the atmosphere and moisture from the radiation sensitive layers.

Generally, in the practice of the present invention, the gas (in the hydrogen contacting step) which is brought into actual contact with the photographic element which is to be "hydrogen sensitized" thereby should contain at least about 10 volume percent of hydrogen, and can contain as much as 100 volume percent of hydrogen if desired. Any remaining portion of the contacting gas should preferably be an inert gas (such as, for example, nitrogen, argon, neon, krypton, helium, and the like). Although a small amount (preferably below about 5 volume percent) of moisture vapor and/or oxygen can sometimes be tolerated in the contacting gas, it should be kept in mind that mixtures of hydrogen and oxygen gases are extremely dangerous due to their extreme explosive potential. Hereinafter, where the term "hydrogen" is utilized (unless specified otherwise) in the descriptive portion of this disclosure, mixtures of $H_2$ with one or more inert gases can be used. Actually, it has been observed that when one desires relatively quick hydrogen sensitization, relatively hotter contacting gas and/or relatively higher concentrations of hydrogen in the contacting gas should be utilized. For example, substantially dry contacting gas consisting essentially of from about 20 to about 50 volume percent of hydrogen and from about 50 to about 80 volume percent of nitrogen represent materials for use in a particularly preferred embodiment of the present invention. It has been observed that mixtures of hydrogen with inert gas(es) function in very much the same manner as does pure hydrogen gas at a corresponding reduced pressure (e.g., 25% hydrogen and ¼ atmosphere).

Although the prior art references noted above describe the use of a variety of gases for the purpose of applying pneumatic pressure to liquid, undried silver halide emulsions, or to silver halide emulsion layers, before exposure to actinic radiation, it has been found that the enhanced results which are achieved in accordance with this invention are only obtained with the use of hydrogen gas. The use of other gases, such as for example, nitrogen or carbon dioxide, or inert gases such as neon, helium, argon, krypton or xenon, fail to provide the enhanced results otherwise achieved in accordance with the process of this invention. It is particularly noteworthy that whereas the prior art is especially concerned with pneumatic pressure as applied to photographic elements, in accordance with this invention the concern is with the treatment of radiation sensitive silver salt layers with hydrogen irrespective of the pressure.

The time during which the hydrogen treatment is maintained can vary widely depending on several factors such as the particular radiation sensitive materials being sensitized, the presence or absence of sensitizing dyes, the temperature of the treatment, the pressure of the hydrogen atmosphere, the desired degree of sensitivity, and the like. Typically, the treatment can be maintained from about 30 seconds to about 3 weeks. In accordance with an embodiment of the invention the hydrogen atmosphere is maintained from about 1 minute to about 24 hours. In accordance with another embodiment of the invention the hydrogen treatment is maintained from about 15 minutes to about 6 hours. In still another embodiment the hydrogen atmosphere is maintained for about 4 hours.

A wide variation in pressures can be suitably employed during the treatment of the radiation sensistive silver layers with hydrogen. The pressure can range from slightly higher than the vacuum pressure employed up to about 100 atmospheres. Preferably the hydrogen treatment is performed at a pressure of from about 0.5 atmospheres to about 10 atmospheres. In accordance with the most preferred aspect the hydrogen treatment is performed at from about 0.8 atmospheres to about 1 atmosphere. Although an increase in sensitivity is obtained in all cases upon treatment of radiation sensitive elements with hydrogen, a decrease in the optimum effects is obtained at very high pressure such as above about 100 atmospheres.

The temperatures maintained during the hydrogen and/or vacuum treatment can range widely; for example, temperatures between 0° and 100°C. are contemplated.

In accordance with another embodiment of the invention there is provided negative-forming radiation sensitive silver halide layers having a substantially constant density when exposed to the same quanta of radiation over a range of from about $10^0$ to about $10^4$ seconds and developed. These layers are produced in accordance with the processes described above. As a basis for a test, for example, of this property, any reasonable developed density can be used. It is preferred, however, that a developed density of about 0.4 above fog be utilized. The use of still lower developed densities can be used for this test in order to more stringently demonstrate the resistance or immunity to "low level reciprocity failure" property of the photographic elements of the present invention. In accordance with a preferred aspect of the invention the radiation sensitive silver halide layers comprise at least one gelatino slver halide emulsion layer on a photographic film support. The radiation sensitive emulsions can be chemically sensitized and/or spectrally sensitized. In a preferred embodiment the radiation sensitive emulsions are chemically and spectrally sensitized.

The process of this invention can be employed for increasing the sensitivity and for reducing the reciprocity law failure for a variety of negative-forming radiation sensitive silver salt layers. The radiation sensistive material can be non-spectrally sensitized, such as x-ray emulsions, electron and particulate recording materials, or emulsions which are orthochromatic, panchromatic, infrared-sensitive and the like containing spectral sensitizing dyes. The photographic silver halide emulsion layers which are treated in accordance with this invention may contain a variety of photographic addenda, including for example, speed increasing compounds, stabilizing compounds or antifogging compounds.

The process of this invention is particularly useful for treating photosensitive silver halide emulsion layers wherein very little or no reciprocity law failure is tolerable. This is applicable, for example, for photographic plates or films for recording images with radiation of so-called short wavelengths, e.g., wavelengths of less than about 400 to 500 nm, for visible radiation, e.g., wavelengths of about 400 to 700 nm or for wavelengths of above about 800 nm in which long exposure times are employed, such as several seconds to several hours or longer. It is also particularly advantageous to treat high speed films in accordance with this invention, especially those films having a log speed greater than about 200. The log speed, as employed herein, equal 100 (1–log E) when the time of exposure is 1/25 of a second and E is the exposure measured in meter-candle-seconds necessary to produce a density of 0.3 above fog when the photographic material is processed for 4 minutes at 21°C in Kodak Developer D–19 diluted 1:1 by volume of water. Kodak Developer D–19 has the following composition:

| | |
|---|---|
| water (about 50°C) | 2.0 liters |
| N-methyl-p-aminophenol sulfate | 8.8 g. |
| sodium sulfite, desiccated | 384.0 g. |
| hydroquinone | 35.2 g. |
| sodium carbonate, desiccated | 192.0 g. |
| potassium bromide | 20.0 g. |
| water to make | 4.0 liters |

The described photosensitive materials employed in the practice of the invention contain photosensitive silver salt, especially a photographic silver salt. Suitable photographic silver salts include silver chloride, silver bromide, silver bromoiodide, silver iodobromide, silver iodochloride, silver chloroiodide, silver chlorobromoiodide or mixtures thereof. The photographic silver halide can be coarse or fine-grain and the emulsion containing the photographic silver halide can be prepared by any of the well-known procedures in the photographic art, such as single-jet emulsions, double-jet emulsions, Lippmann emulsions, ammoniacal emulsions, thiocyanate or thioether ripened emulsions, such as those described in the U.S. Pat. No. 2,222,264 of Nietz et al. issued Nov. 14, 1940; U.S. Pat. No. 3,320,069 of Illingsworth issued May 15, 1967 and U.S. Pat. No. 3,271,157 of McBride issued Sept. 6, 1966.

Surface image silver halide emulsions can be used or internal image silver halide emulsions such as those described in U.S. Pat. No. 2,592,250 of Davey et al. issued Apr. 8, 1952 and U.S. Pat. No. 3,206,313 of Porter et al. issued Sept. 14, 1965. If desired, mixtures of surface and internal image silver halide emulsions can be used as described in U.S. Pat. No. 2,996,382 of Luckey et al. issued Apr. 15, 1961. The silver halide emulsion can be a regular grain emulsion such as cubic or octahedral silver halide crystals having a single morphology, as described in Klein and Moisar, *Journal of Photographic Science*, Volume 12, No. 5, September–October 1964, pages 242–251.

The silver halide emulsion employed in the practice of the invention can be unwashed or washed to remove soluble salts. In the latter case the soluble salts can be removed by chill setting and leaching or the emulsion can be coagulation washed.

The silver halide employed in the practice of the invention can be sensitized with chemical sensitizers, such as with reducing agents; sulfur, selenium, or tellurium compounds; gold, platinum or palladium compounds; or combinations of these. Suitable procedures are described, for example, in U.S. Pat. No. 1,623,499 of Sheppard issued Apr. 5, 1927; U.S. Pat. No. 2,399,083 of Waller et al. issued Apr. 23, 1946; U.S. Pat. No. 3,297,447 of McVeigh issued Jan. 10, 1967 and U.S. Pat. No. 3,297,446 of Dunn issued Jan. 10, 1967.

The silver halide emulsions used with this invention can contain speed increasing compounds, such as polyalkylene glycols, cationic surface active agents and thioethers or combinations of these as described in U.S. Pat. No. 2,886,437 of Piper, issued May 12, 1959; U.S. Pat. No. 3,046,134 of Dann et al., issued July 24, 1962; U.S. Pat. No. 2,944,900 of Carroll et al, issued July 12, 1960 and U.S. Pat. No. 3,294,540 of Goffe, issued Dec. 27, 1966.

Phatographic silver halide emulsions employed in the practice of the invention can be protected against the production of fog and can be stabilized against loss of sensistivity during keeping. Suitable antifoggants and stabilizers, e.g. used alone or in combination include, for example, thiazolium salts; azaindenes; mercury salts as described, for example, in U.S. Pat. No. 2,728,663 of Allen et al. issued Dec. 27, 1955; urazoles; sulfocatechols; oximes described, for example, in British Pat. No. 623,448; nitron; nitroindazoles; polyvalent metal salts described, for example, in U.S. Pat. No. 2,839,405 of Jones issued June 17, 1958; platinum, palladium and gold salts described, for example, in U.S. Pat. No. 2,566,263 of Trivelli et al. issued Aug. 28, 1951 and U.S. Pat. No. 2,597,915 of Yutzy et al. issued May 27, 1952.

The photographic elements employed in the practice of the invention can contain incorporated developing agents, such as hydroquinones, catechols, aminophenols, 3-pyrazolidones, ascorbic acid and its derivatives, reductones and phenylenediamines. Combinations of developing agents can be employed in the practice of the invention. The developing agents can be in a photograhic silver halide emulsion and/or in another suitable location in the photographic element. The developing agents can be added from suitable solvents or in the form of dispersions.

The photographic and other layers of an element used in the practice of this invention can be hardened by various organic or inorganic hardeners, alone or in combinations, such as aldehydes, and blocked aldehydes, ketones, carboxylic and carbonic acid derivatives, sulfonate esters, sulfonyl halides and vinyl sulfonyl ethers, active halogen compounds, epoxy compounds, aziridines, active olefins, isocyanates, carbodiimides, mixed-function hardeners and polymeric hardeners such as oxidized polysaccarides like dialdehyde starch and oxyguargum and the like.

A photographic element or emulsion described and used in the practice of the invention can contain various colloids alone or in combination as vehicles, binding agents and in various layers. They are transparent or translucent and include both naturally-occurring substances such as proteins, for example, gelatin, gelatin derivatives, cellulose derivatives, polysaccharides such as dextran, gum arabic and the like; and synthetic polymeric substances such as water-soluble polyvinyl compounds like poly(vinyl pyrrolidone), acrylamide polymers and the like. Other synthetic polymeric compounds which can be employed include polyvinyl butyral, ethyl cellulose, polyvinylidene chloride, dispersed vinyl compounds such as in latex form and particularly those which increase dimensional stability of photographic materials. Suitable synthetic polymers include those described in U.S. Pat. No. 3,142,586 of Nottorf issued July 28, 1964; 3,193,386 of White issued July 6, 1965; 3,062,674 of Houck et al. issued Nov. 6, 1962; 3,220,844 of Houck et al. issued Nov. 30, 1965; 3,287,289 of Ream et al. issued Nov. 22, 1966 and 3,411,911 of Dykstra issued Nov. 19, 1968. Effective polymers include water insoluble polymers of alkyl acrylates and methacrylates, arylic acid, sulfoalkyl acrylates or methacrylates, and those which have crosslinking sites which facilitate hardening and curing as well as those having recurring sulfobetaine units as described in Canadian Pat. No. 774,054. Binderless photosensitive silver compounds can be employed, such as described in British Pat. No. 1,134,007 and British Pat. No. 977,291.

The photographic and other layers of an element employed in the practice of the invention and described herein can be coated on a wide variety of supports. Typical supports include cellulose nitrate film, cellulose ester film, poly(vinylacetal) film, polystyrene film, poly(ethylene terephthalate) film, polycarbonate film and related films or resinous materials, as well as glass, paper, metal and the like. In the case of a paper support, it can be partially acetylated or coated with baryta and/or an alpha olefin polymer, particularly a polymer of an alpha olefin containing 2 to 10 carbon atoms such as polyethylene, polypropylene, ethylene-butene copolymers and the like.

The photographic elements used in the practice of the invention can contain antistatic or conducting layers. Such layers can comprise soluble salts such as chlorides, nitrates and the like, evaporated metal layers, ionic polymers such as those described in U.S. Pat. Nos. 2,861,056 of Minsk issued Nov. 18, 1958 and 3,206,312 of Sterman et al. issued Sept. 14, 1965 or insoluble inorganic salts such as those described in U.S. Pat. No. 3,428,451 of Trevoy issued Feb. 18, 1969.

The photographic layers or other layers employed in the practice of the invention can contain plasticizers and lubricants. Suitable plasticizers and lubricants include, for example, polyalcohols alcohols such as glycerin and diols described, for example, in U.S. Pat. No. 2,960,404 of Milton et al. issued Nov. 1, 1966; fatty acids or esters such as those described in U.S. Pat. No.

2,588,765 of Robijns issued Mar. 11, 1952; U.S. Pat. No. 3,121,060 of Duane issued Feb. 11, 1964 and silicone resins such as those described in British Pat. No. 955,061.

The photographic layers or other layers employed in the practice of the invention can contain surfactants such as saponin; anionic compounds such as alkyl aryl sulfonates described, for example, in U.S. Pat. No. 2,600,831 of Baldsiefen issued June 17, 1962; amphoteric compounds such as those described in U.S. Pat. No. 3,133,816 of Ben-Ezra issued May 19, 1964; and adducts of glycidol and an alkyl phenol such as those described in British Pat. No. 1,022,878.

If desired, the photographic elements employed in the practice of the invention can contain matting agents such as starch, titanium dioxide, zinc oxide, silica, polymeric beads including beads described, for example, in U.S. Pat. No. 2,922,101 of Jelley et al. issued July 11, 1961 and U.S. Pat. No. 2,701,245 of Lynn issued Feb. 1, 1955.

The photographic elements employed in the practice of the invention can contain brightening agents or scintillating agents including stilbenes, triazines, oxazoles and coumarin brightening agents. Water-soluble brightening agents can be used as those described in German Pat. No. 972,067 and U.S. Pat. No. 2,933,390 of McFall et al. issued Apr. 19, 1960 or dispersions of brighteners can be used such as those described in German Pat. No. 1,150,274; U.S. Pat. No. 3,406,070 of Oetiker et al. issued Oct. 15, 1968 and French Pat. No. 1,530,244.

The various layers including the photographic layers of an element employed in the practice of the invention can contain light-absorbing or scattering materials, such as colloidal silver, and filter dyes such as those described in U.S. Pat. No. 3,253,921 of Sawdey issued May 31, 1966; U.S. Pat. No. 2,274,782 of Gaspar issued Mar. 3, 1942; U.S. Pat. No. 2,527,583 of Silberstein et al. issued Oct. 31, 1950; and U.S. Pat. No. 2,956,583 of VanCampen issued Oct. 18, 1960. If desired, the dyes can be mordanted, for example, as described in U.S. Pat. No. 3,282,699 of Jones et al. issued Nov. 1, 1966.

The photographic layers used in the practice of the invention can be coated by various coating procedures including dip coating, airknife coating, curtain coating or extrusion coating using hoppers such as described in U.S. Pat. No. 2,681,294 of Beguin issued June 15, 1954. If desired, two or more layers can be coated simultaneously such as by the procedures described in U.S. Pat. No. 2,761,791 of Russell issued Sept. 4, 1956 and British Pat. No. 837,095.

The photosensitive materials employed in the practice of the invention, e.g. photographic elements and emulsions, can contain spectral sensitizing dyes to confer added sensitivity to the photosensitive material, e.g. photographic silver halide, employed in the practice of the invention. For instance, additional spectral sensitization can be obtained by treating the silver halide with a solution of a sensitizing dye in an appropriate solvent, such as in an organic solvent or the dye can be added in the form of a dispersion as described in British Pat. No. 1,154,781. For optimum results the dye can either be added to the emulsion as a final step or at some earlier stage.

Sensitizing dyes useful in sensitizing silver halide emulsions are described, for example, in U.S. Pat. No. 2,526,632 of Brooker et al. issued Oct. 24, 1950; U.S. Pat. No. 2,503,776 of Sprague issued Apr. 11, 1950; U.S. Pat. No. 2,493,748 of Brooker et al. issued Jan. 10, 1950 and U.S. Pat. No. 3,384,486 of Taber et al. issued May 21, 1968. Spectral sensitizers which can be used include the cyanines, merocyanines, complex (trinuclear or tetranuclear) merocyanines, complex (trinuclear or tetranuclear) cyanines, holopolar cyanines, styryls, hemicyanines such as enamine hemicyanines, oxonols and hemioxonols. Dyes of the cyanine classes can contain such basic nuclei as the thiazolines, oxazolines, pyrrolines, pyridines, oxazoles, thiazoles, selenazoles, and imidazoles. such nuclei can contain alkyl, alkylene, hydroxyalkyl, sulfoalkyl, carboxyalkyl, aminoalkyl, and enamine groups that can be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

The merocyanine dyes can contain the basic nuclei described as well as acid nuclei such as thiohydantoins, rhodanines, oxazolidenediones, thiazolidenediones, barbituric acids, thiazolineones, and malononitrile. These acid nuclei can be substituted with alkyl, alkylene, phenyl, carboxyalkyl, sulfoalkyl, hydroxyalkyl, alkoxyalkyl, alkylamino groups, or heterocyclic nuclei. Combinations of these dyes can be used, if desired. In addition supersensitizing addenda which do not absorb visible light may be included such as, for instance, ascorbic acid derivatives, azaindenes, cadmium salts, and organic sulfonic acid as described in U.S. Pat. No. 2,933,390 of McFall et al issued Apr. 19, 1960 and U.S. Pat. No. 2,937,089 of Jones et al. issued May 17, 1960.

The sensitizing dyes and other addenda used in the practice of the invention can be added from water solutions or suitable organic solvent solutions can be used. The compounds can be added using various procedures including, for example, those described in U.S. Pat. No. 2,912,343 of Collins et al. issued Nov. 10, 1959; U.S. Pat. No. 3,342,605 of McCrossen et al. issued Sept. 19, 1967; U.S. Pat. No. 2,996,287 of Audran issued Aug. 15, 1961 and U.S. Pat. No. 3,425,835 of Johnson et al. issued Feb. 4, 1969.

As described, the process can be employed for treatment of other photographic elements also, such as those described in U.S. Pat. No. 2,756,227 of Heseltine, issued July 24, 1956 and U.S. Pat. No. 2,734,900 of Heseltine, issued Feb. 14, 1956. The invention can be employed for preparing elements designed for colloid transfer processes, such as described in U.S. Pat. No. 2,716,059 of Yutzy et al., issued Aug. 23, 1955, silver salt diffusion transfer processes, such as described in U.S. Pat. No. 2,352,014 of Rott, issued June 20, 1944; U.S. Pat. No. 2,543,181 of Land, issued Feb. 27, 1951; U.S. Pat. No. 3,020,155 of Yackel et al., issued Feb. 6, 1962; and U.S. Pat. No. 2,861,885 of Land, issued Nov. 25, 1958; as well as elements designed for color image transfer processes, such as described in U.S. Pat. No. 3,087,817 of Rogers, issued Apr. 30, 1963; U.S. Pat. No. 3,185,567 of Rogers, issued May 25, 1965; and U.S. Pat. No. 2,983,606 of Rogers, issued May 9, 1961; and photographic elements employed for imbibition transfer processes, such as described in U.S. Pat. No. 2,882,156 of Minsk, issued Apr. 14, 1959.

The process can be employed for treating elements designed for physical development, such as described in British Pat. No. 920,277 published Mar. 6, 1963; and British Pat. No. 1,131,238 published Oct. 23, 1968.

The process of the invention is useful for sensitizing photosensitive materials designed for color photography. This includes, for example, elements containing color-forming couplers, such as described in U.S. Pat. Nos. 2,376,679 of Frohlich et al., issued May 22, 1945; 2,322,027 of Jelley et al. issued June 15, 1943; 2,801,171 of Fierke et al. issued July 30, 1957; 2,698,794 of Godowsky issued Jan. 4, 1955; 3,227,554 of Barr et al. issued Jan. 4, 1966 and 3,046,129 of Graham et al. such as described in 2,376,679 of Frohlich et al., issued May 22, 1945; 2,322,027 of Jelley et al. issued June 15, 1943; 2,801,171 of Fierke et al. issued July 30, 1957; 2,698,794 of Godowsky issued Jan. 4, 1955; 3,227,554 of Barr et al. issued Jan. 4, 1966 and 3,046,129 of Graham et al. issued July 24, 1962. It also includes, for example, elements designed to be developed in solutions containing color-forming couplers, such as described in U.S. Pat. 2,252,718 of Mannes et al. issued Aug. 19, 1941; 2,592,243 of Carroll et al. issued Apr. 8, 1952 and 2,950,970 of Schwan et al. issued Aug. 30, 1960. The process can also be employed for treatment of so-called false-sensitized color materials, such as those described in 2,763,549 of Hanson issued Sept. 18, 1956.

Photographic elements prepared according to the invention can be processed by various methods, after exposure, including processing in silver halide developer solutions containing various silver halide developing agents, such as alkaline solution containing such silver halide developing agents as hydroquinones, catechols, aminophenols, 3-pyrazolidones, ascorbic acid and ascorbic acid derivatives, hydroxylamines, hydrazines, reductones, and the like. The elements can be processed by so-called web processing, such as described in U.S. Pat. No. 3,179,517 of Tregillus et al issued Apr. 20, 1965; stabilization processing, such as described in Russell et al., "Stabilization Processing of Films and Papers," P.S.A. Journal Vol. 16B, August, 1950; monobath processing, such as described in "The Monobath Manual," by Grant M. Haist, 1966 and U.S. Pat. No. 3,392,019 of Barnes et al. issued July 9, 1968. If desired, photographic elements prepared according to the invention can be processed in hardening developers, such as described in U.S. Pat. No. 3,232,761 of Allen et al. issued Feb. 1, 1966; in roller transport processors, such as described in U.S. Pat. No. 3,025,779 of Russell et al., issued Mar. 20, 1962 or by surface application processing, such as described in U.S. Pat. No. 3,418,132 of Kitze issued Dec. 24, 1968.

The present invention is useful in resensitizing photographic elements which have been chemically desensitized by, for example, incorporating into the silver halide emulsion layer one or more dyes having the ability to desensitize silver halide. One valuable adaptation of this aspect of the present invention involves exposing the "desensitized" element to fairly large amounts of radiation (for example, by handling it in room light), followed by treating the element via the present processes, whereby the element surprisingly acquires a photographic sensitivity of a very high degree, often higher than was believed possible before using the particular ingredients. One limitation upon this particular adaptation of this invention relates to the apparent requirement that elements "resensitized" in this way must be imagewise exposed while the element remains protected from oxygen and moisture.

The process of the invention can be used for treatment of photosensitive silver halide layers used for providing high contrast images, such as employed in the graphic arts. These can be so-called lith emulsions. Also the silver halide emulsion containing elements of this invention, on an appropriate substrate and appropriately sensitized, can be employed for making lithographic printing plates.

As described herein, this invention is advantageously employed in combination with photographic systems adapted for dry process. Stabilized print out elements are typical of the silver halide photographic elements adapted for dry process.

Typical of photographic layers capable of being dry processed and which are advantageously treated in accordance with this invention are the so-called "photosensitive elements", (i.e., a "latent image" is formed imagewise in the exposed areas of a silver salt layer) and "thermosensitive elements" (i.e., substantially permanent visible images of photographic sharpness and high visual contrast can be produced within seconds through the mere application of heat).

Typically, a "dry photographic" element comprises a support having thereon an oxidation-reduction image forming combination said combination comprising a silver salt, preferably an organic silver salt, and a reducing agent, and a catalyst for the oxidation-reduction image forming combination. Typical "dry photographic" products are described in U.S. Pat. No. 3,392,020 of Yutzy et al. issued July 9, 1969, and in co-pending U.S. application Ser. No. 27,105 of Evans entitled "Photosensitive and Thermosensitive Elements, Compositions and Processes" filed Apr. 9, 1970 (now U.S. Pat. No. 3,667,958, issued June 6, 1972), In co-pending application Ser. No. 33,964 of deMauriac entitled "Element, Composition and Process" and filed May 1, 1970 (now U.S. Pat. No. 3,672,904, issued June 27, 1972), and in co-pending U.S. application Ser. No. 70,466 of deMauriac and Gaugh, entitled "Element, Composition and Process" filed Sept. 8, 1970 (now U.S. Pat. No. 3,761,279, issued Sept. 25, 1973).

Any of the typical reducing agents can be employed in combination with the oxidation portion of the image forming system, such as for example, the prior art silver halide reducing agents as described in deMauriac, U.S. Ser. No. 33,964 filed May 1, 1970 (now U.S. Pat. No. 3,762,904, issued June 27, 1972).

As the oxidizing agent, of the oxidizing-reduction image forming combination, a silver salt of an organic acid is preferably employed. The silver salt of an organic acid should be resistant to darkening under illumination to prevent undesired deterioration of a developed image. An especially suitable class of silver salts of organic acids is the water insoluble silver salts of long-chain fatty acids which are stable to light. Typically, the silver salts include silver behenate, silver stearate, silver oleate, silver laurate, silver hydroxystearate, silver caprate, silver myristate, and silver palmitate. Other suitable oxidizing agents are silver benzoate, silver phthalazinone, silver benzotriazole, silver saccharin, silver 4'-n-octadecyloxydiphenyl-4-carboxylic acid, silver orthoaminobenzoate, silver acetamidobenzoate, silver furoate, silver camphorate, silver p-phenylbenzoate, silver phenyl acetate, silver salicylate, silver butyrate, silver terephthalate, silver phthalate, silver acetate, and silver acid phthalate. Nonsilver salts can be employed as oxidizing agents, such as zinc oxide, gold stearate, mercuric behenate, auric behenate and the like; however, silver salts are generally preferred.

Typically, a photosensitive silver salt is present in "dry photographic" elements in minor or catalytic amounts and in catalytic proximity to the oxidation image forming component of the image forming combination. A suitable concentration range of the catalyst is generally from about 0.01 to about 0.50 mole of photosensitive silver salt per mole of oxidizing agent. Suitable silver salts include photosensitive silver halides, e.g., silver chloride, silver bromide, silver bromoiodide, silver chlorobromoiodide, or mixtures thereof. The photosensitive silver halide can be coarse or fine-grain, very fine-grain emulsions being especially useful. The emulsion containing the photosensitive silver halide can be prepared by any of the well-known procedures in the photographic art such as described above.

The "dry photographic" elements preferably contain an activator-toning agent. Suitable activator-toning agents which can be employed include cyclic imides such as:

Phthalimide,
N-Hydroxyphthalimide,
N-Potassium phthalimide,
N-Mercury phthalimide,
Succinimide, and
N-Hydroxysuccinimide.

Other activator-toning agents can be employed in combination with or in place of the cyclic imides. Such other activator-toning agents are generally heterocyclic compounds containing at least two hetero atoms in the heterocyclic ring at least one being nitrogen. Illustrative compounds include phthalazinone, phthalic anhydride, 2-acetylphthalazinone and 2-phthalylphthalazinone. Grant, U.S. Pat. No. 3,080,254 issued Mar. 5, 1963, and Workman U.S. Pat. No. 3,446,648 issued May 27, 1969, describe suitable activator-toning agents.

Activator-toning agents are suitable employed at a concentration of about 0.10 mole to about 1.05 moles per mole of oxidizing agent, however, lower and higher concentrations can be employed.

The exact mechanism by which the process of the invention provides increased sensitivity and reduced reciprocity law failure as evidenced by the substantially constant density obtained by radiation sensitive materials when exposed to the same quanta of radiation over a range of from about $10^{\circ}$ seconds to about $10^4$ seconds and developed is not fully understood. However, as demonstrated herein, surprisingly increased sensitivity and reduced reciprocity law failure is provided according to the invention. For example, recording film containing a photographic silver halide emulsion which is chemically sensitized to a high speed can be further sensitized according to the invention.

The following examples are included for a further understanding of the invention.

EXAMPLE 1

A photographic element is prepared by coating and drying conventionally an aqueous photographic silver iodobromide gelatino emulsion on a poly(ethylene terephthalate) film support at a coverage of 60 mg of silver per square foot and 125 mg. of gelatin per square foot. The silver iodobromide emulsion is not chemically sensitized and contains no spectral sensitizing dyes.

The photographic element is exposed sensitometrically through a step tablet in room air, at room temperature, i.e. about 20°C and atmospheric pressure. The photographic element is exposed for 100 seconds to a 1000-watt tungsten lamp through a Wratten 7 glass filter and an infrared blocking filter which provides transmission of light in the range of 483 to 340 n.m., i.e. the region of inherent sensitivity of the silver halide. The tungsten lamp is operated at a color temperature of 3000°K and at a distance of 175 centimeters from the surface of the silver halide emulsion.

The resulting latent image in the photographic element is developed by immersing the photographic element in a developer solution for 5 minutes at 20°C. The developer solution contains:

| | |
|---|---|
| N-methyl-p-aminophenol sulfate | 2.5 g. |
| ascorbic acid | 10.0 g. |
| sodium meta borate | 35.0 g. |
| potassium bromide | 1.0 g. |
| water to make | 1 liter |

The photographic element is thereafter immersed for four minutes in a fixing solution containing the following components:

| | |
|---|---|
| sodium thiosulfate | 240.0 g. |
| sodium sulfite (desiccated) | 15.0 g. |
| acetic acid (28%) | 48.0 cc. |
| boric acid, crystals | 7.5 g. |
| potassium alum | 15.0 g. |
| water to make | 1 liter |

The photographic element is then washed with water and permitted to dry in room air under ambient conditions. This is used as a control and designated as photographic element A. The relative photographic speed of Photographic Element A, measured at a density of 0.2 above fog, is 100. The control has a gamma of 1.12.

A photographic element is prepared the same as photographic element A. This is designated as photographic element B. It is placed in a vacuum sensitometer, similar to the one described in *Photographic Science and Engineering*, Volume, 13, pages 54–64, 1969. The sensitomer is evacuated to a pressure of $10^{-7}$ torr. Hydrogen is then added to the sensitometer until a pressure of 0.8 atmosphere is reached. The photographic element B is permitted to stand in the hydrogen atmosphere for four hours. The hydrogen atmosphere is then removed and the element is sensitometrically exposed and the resulting latent image developed and fixed in the same manner as photographic element A. The relative photographic speed of photographic element B, compared to control photographic element A, is 2460, measured at a density of 0.2 above fog. The gamma is 3.75.

EXAMPLE 2

The procedure set out in Example 1 is repeated with the exception that the photographic silver iodobromide emulsion is chemically sensitized in the conventional manner with sodium thiosulfate before the emulsion is coated on the poly(ethylene terephthalate) support.

The control photographic element is designated as photographic element C and has a relative photographic speed of 100 and gamma of 2.01. An identical photographic element which is subjected to vacuum and treated with hydrogen as set out in Example 1 is designated as photographic element D. Upon processing, as described in Example 1, photographic element D has a relative photographic speed of 1090 compared to control photographic element C and a gamma of 3.32.

EXAMPLE 3

A photographic silver bromide galatino emulsion is prepared as described in an article by Spencer and Atwell, in the *Journal of the Optical Society of America,* Vol. 54, pages 498–505 (1964). The photographic emulsion is prepared without chemical sensitization and without spectral sensitization, i.e. without adding spectral sensitizing dyes. A photographic element is prepared by coating and drying conventionally the resulting emulsion on a poly(ethylene terephthalate film support at a coverage of 60 mg of silver per square foot and 125 mg. of gelatin per square foot.

The photographic element is exposed sensitometrically and the resulting latent image is developed in the same manner as in Example 1. This is employed as a control and designated as photographic element E. It has a relative photographic speed, in room air, of 100 and a gamma of 1.63.

An identical photographic element, designated as photographic element F, before exposure to subjected to vacuum and treated with hydrogen as set out in Example 1. Upon processing, as described in Example 1, photographic element F has a relative photographic speed of 217 compared to control photographic element E and a gamma of 2.87.

EXAMPLE 4

The procedure set out in Example 3 is repeated with the exception that the described photographic silver halide emulsion is reduction sensitized by digestion for one hour at 65°C in the presence of 20 mg. of thioureadioxide per mole of silver.

The exposure and processing steps are identical to that described in Example 1. One photographic element employing the described emulsion is prepared as a conrol (G) is not treated with hydrogen. Another element, designated as photographic element H, is prepared in the same manner with the exception that it is subjected to vacuum and treated with hydrogen as described in Example 1.

The photographic element G, employed as a control, has a relative photographic speed of 100 and a gamma of 2.98. The photographic element H has a photographic seed of 178 compared to control photographic element G and gamma of 3.68.

EXAMPLE 5

The procedure set out in Example 3 repeated with the exception that the photographic silver bromide emulsion is chemically sensitized with sodium thiosulfate.

A control, designated as photograhic element I, which is not treated with hydrogen, has a relative photographic speed of 100 and gamma of 1.65. An identical photographic element, designated as photographic element J, which is treated with hydrogen, as described in Example 1, has a relative photographic speed of 354 compared to control photographic element I and a gamma of 3.40.

EXAMPLE 6

The procedure set out in Example 3 is repeated with the exception that the photographic silver bromide emulsion is chemically sensitized with a combination of sodium thiosulfate and potassium chloroaurate.

A control, designated as photographic element K, which is not treated with hydrogen, has a relative photographic speed of 100 and a gamma of 1.51. An identical photographic element, designated as photographic element L, which is subjected to vacuum and treated with hydrogen, as described in Example 1, has a relative photographic speed of 234 compared to control photographic element K and a gamma of 2.60.

EXAMPLE 7

A photographic silver bromide emulsion is prepared as described in Example 3, but with no deliberate chemical sensitization, with the exception that the silver bromide grains are ripened to an average grain size of 0.32 microns.

A photographic element is prepared employing this emulsion and exposed as described in Example 3 with the exception that the intensity of the light is reduced by the use of neutral density filters.

The resulting latent image is developed by immersion in a developer, as described in Example 1, for 10 minutes. The photographic element, before exposure, is not treated with hydrogen. The relative photographic speed of the element, in arbitrary units, measured at a density of 0.1 above fog, is 100. The element has a gamma of 1.33.

An identical photographic element is subjected to vacuum and treated with hydrogen, as described in Example 3, before exposure and processing. The relative photographic speed of this element, measured at a density of 0.1 above fog, is 734 compared to the control which is not treated with hydrogen and the element has a gamma of 3.60.

EXAMPLE 8

A photographic silver bromide emulsion is prepared, as described in Example 3, with no deliberate chemical sensitization, with the exceptions that the silver bromide grains are ripened to an average grain size of 0.32 microns and 75 mg. of 1,1′-diethyl-2,2′-cyanine chloride (sensitizing dye) is added per mole of silver present in the emulsion.

A photographic element is prepared, as described in Example 3, with this emulsion. It is subjected to vacuum and treated with hydrogen, exposed and processed as described in Example 1. The element has a relative photographic speed of 1360 and a gamma of 3.40.

An identical photographic element, which is not treated with hydrogen, has a relative photographic speed of 100 and a gamma of 3.40.

EXAMPLE 9

A non-chemically sensitized photographic silver bromide emulsion is prepared, as described in Example 3. The silver bromide grains are ripened to an average grain size of 0.32 microns and 75 mg. of 1,1′-diethyl-2,2′-cyanine chloride (sensitizing dye) is added per mole of silver present in the emulsion.

A photographic element is prepared, as described in Example 3, with this emulsion. It is subjected to vacuum and treated with hydrogen and exposed, as described in Example 1, with the exception that a minus blue Wratten 23 glass filter is placed over the light source in place of the Wratten 7 glass filter. This provides a so-called wavelength cut off at 520 nm. This provides an exposure of the photographic element to radiation absorbed only by the described sensitizing dye.

The photographic element is processed as described in Example 1. The element has relative photographic speed of 1460 and a gamma of 1.42.

An identical element, which is not treated in accordance with the invention, but which is otherwise exposed and processed in the same manner, has a relative photographic speed of 100 and a gamma of 0.50.

EXAMPLE 10

A photographic silver bromide emulsion is prepared, as described in Example 3, with the exception that the emulsion is chemically sensitized to optimum photographic response with a combination of sodium thiosulfate and potassium chloroaurate. Also the silver bromide grains are ripened to an average grain size of 0.32 microns.

A photographic element is prepared with the resulting emulsion, subjected to vacuum and treated with hydrogen and exposed as described in Example 3, with the exception that the intensity of the light is reduced with the use of neutral density filters over the light source. The element is processed as described in Example 1. The resulting photographic element has a relative photographic speed of 674 and a gamma of 1.21.

An identical photographic element is prepared and processed, as described with the exception that the element is not treated in accordance with the invention. The element has a relative photographic speed of 100 and a gamma of 1.63.

EXAMPLE 11

A photographic silver bromide emulsion is prepared, as described in Example 3, with the exception that the emulsion is chemically sensitized to optimum photographic response with a combination of potassium chloroaurate and sodium thiosulfate. Also the silver bromide grains are ripened to an average grain size of 0.32 microns and 75 mg. of 1,1'-diethyl-2,2'-cyanine chloride (sensitizing dye) per mole of silver is added to the emulsion.

A photographic element is prepared with the resulting emulsion, subjected to vacuum and treated with hydrogen and exposed as described in Example 3, with the exception that the intensity of the light is reduced with the use of neutral density filters over the light source. The element is processed as described in Example 1. The resulting element has a relative photographic speed of 2230 and a gamma of 1.05.

An identical photographic element is prepared and processed, as described, with the exception that the element is not treated with hydrogen. The element has a relative photographic speed of 100 and a gamma of 1.12.

EXAMPLE 12

A photographic element is prepared, with vacuum and hydrogen treatment, as described in Example 11. The photographic element is exposed as described in Example 1, but with a Wratten 23 glass filter over the light source as described in Example 9. This exposes the photographic element to radiation absorbed only by the described sensitizing dye.

The resulting photographic element upon processing, as described in Example 1, has a relative photographic speed of 1880 and a gamma of 0.95.

An identical element which is prepared, exposed and processed in the same manner, but without hydrogen treatment, has a photographic speed of 100 and a gamma of 0.59.

EXAMPLE 13

A high speed, panchromatically sensitized, photographic silver halide film (described in FIG. II of U.S. Pat. No. 2,996,382) is placed in a vacuum sensitometer, similar to the one described in *Photographic Science and Engineering*, Volume 13, pages 54–64, 1969. The sensitometer is evacuated to a pressure of $10^{-7}$ torr. Hydrogen, in the absence of other atmospheric gases, is then added to the sensitometer until a pressure of 0.8 atmosphere is reached. The photographic film is permitted to stand in the hydrogen atmosphere for four hours. The hydrogen atmosphere is then removed and the element is sensitometrically exposed in vacuum to the same light source, as described in Example 1, with the light being filtered through a Wratten 80A filter. The resulting latent image is developed by immersing the photographic film in a developer solution for 15 minutes at 20°C. The developer solution contains

| | | | |
|---|---|---|---|
| N-methyl-p-amino phenol sulfate | | 4.5 | g. |
| sodium sulfite, desiccated | | 90.0 | g. |
| hydroquinone | | 17.5 | g. |
| sodium carbonate, monohydrated | | 52.5 | g. |
| potassium bromide | | 5.0 | g. |
| water | to | 1 | liter |

The image is then fixed by immersing the film in the fixing solution, described in Example 1, for 8 minutes. The film is then washed with water for 10 minutes.

The resulting film has a relative photographic speed, measured at a density of 0.4 above fog, of 175 and a gamma of 2.24.

An identical film is prepared, exposed and processed in the same manner with the exception that it is not treated with hydrogen. The resulting film has a relative photographic speed of 100 and a gamma of 2.45.

EXAMPLES 14–22

A series of photographic elements, having the composition given in the following table, are each placed in a vacuum sensitometer, as described in Example 1. The sensitometer is evacuated to a pressure of $10^{-7}$ torr. Hydrogen, in the absence of other atmospheric gases, is then added to the sensitometer until a partial pressure of 1.0 atmosphere is reached. Each photographic element is permitted to stand in the hydrogen atmosphere for three hours at room temperature, i.e. about 20°C. Each is then removed from the hydrogen and sensitometrically exposed, in air, under atmospheric conditions, to a 1000 watt quartz-iodine lamp operated at 6.0 amps. The light source is placed 82 centimeters from the photographic element and the light from the source is filtered through a Wratten 7 filter and an infrared filter. The light is evenly distributed over the photographic element. After exposure, the resulting latent image is developed by immersing the element in a developer, as described in Example 13, for 5 minutes, and then fixed by immersing the element for 10 minutes in a fixer, as described in Example 1. The element is then washed with water for 20 minutes.

Log relative It points, as well as log of relative intensity of exposure and exposure time in seconds, are recorded for each of the photographic elements. Density is read in each instance at 0.6 density units above Dmin.

The procedure is repeated with an identical photographic element in each case, with the exception that the hydrogen treatment, as described, is omitted. This is employed as a control.

The results which are obtained are set out in the following table. In each case, the photographic element is a glass plate support containing a gelatino photographic silver iodobromide or silver bromide emulsion layer with or without spectral sensitization.

| Example No. | Photographic Element | Exposure Time In Seconds | Relative Photographic Speed | Mole % Iodide in Silver Halide Emulsion | Contrast | Spectral Sensitivity |
|---|---|---|---|---|---|---|
| 14 | 14A (invention) | 0.15 | 141 | 1.5 | medium | inherent blue |
| | 14B (control) | 0.15 | 100 (log speed is 330) | 1.5 | medium | inherent blue |
| 15 | 15A (invention) | 1,000 | 246 | 9 | medium | inherent blue |
| | 15B (control) | 1,000 | 100 (log speed is 280) | 9 | medium | inherent blue |
| 16 | 16A (invention) | 0.15 | 126 | 4 | medium | inherent blue |
| | 16B (control) | 0.15 | 100 | 4 | medium | inherent blue |
| 17 | 17A (invention) | 1,000 | 218 | 4 | medium | inherent blue |
| | 17B (control) | 1,000 | 100 | 4 | medium | inherent blue |
| 18 | 18A (invention) | 1.2 | 141 | 1 | high | inherent blue |
| | 18B (control) | 1.2 | 100 | 1 | high | inherent blue |
| 19 | 19A (invention) | 1,000 | 465 | 0 (pure silver bromide) | high | orthosensitized 480–550 nm. |
| | 19B (control) | 1,000 | 100 | 0 (pure silver bromide) | high | orthosensitized 480–550 nm. |
| 20 | 20A (invention) | 10,000 | 296 | 4 | medium | 480–600 nm. |
| | 20B (control) | 10,000 | 100 | 4 | medium | 480–600 nm. millimicrons |
| 21 | 21A (invention) | 10,000 | 490 | 9 | high | 480–680 nm. |
| | 21B (control) | 10,000 | 100 (log speed is 270) | 9 | high | 480–680 nm. |
| 22 | 22A (invention) | 10,000 | 935 | 2 | medium | 680–890 nm. |
| | 22B (control) | 10,000 | 100 (log speed is 280) | 2 | medium | 680–890 nm. |

In each instance, there is no adverse increase in fog or contrast compared to the control.

Reciprocity law failure is measured for each of the elements 14A through 22B at a density of 0.6 above Dmin. The log relative I (meter candles), the log relative It (meter candle seconds) and exposure time in seconds are as follows:

| TREATED ACCORDING TO THE INVENTION | | | | CONTROL | | |
|---|---|---|---|---|---|---|
| Element | Log Relative I | Log Relative It | Exposure Time in Seconds | Element | Log Relative I | Log Relative It |
| 14A | −4.50 | −0.50 | $10^4$ | 14B | −3.96 | 0.04 |
| 14A | −3.56 | −0.56 | $10^3$ | 14B | −3.20 | −0.20 |
| 14A | −2.60 | −0.60 | $10^2$ | 14B | −2.40 | −0.40 |
| 14A | −1.66 | −0.66 | $10^1$ | 14B | −1.52 | −0.52 |
| 14A | −0.68 | −0.68 | $10^0$ | 14B | −0.52 | −0.52 |
| 15A | −4.30 | −0.3 | $10^4$ | 15B | −3.92 | 0.08 |
| 15A | −3.30 | −0.3 | $10^3$ | 15B | −2.96 | 0.04 |
| 15A | −2.30 | −0.3 | $10^2$ | 15B | −2.04 | −0.04 |
| 15A | −1.30 | −0.3 | $10^1$ | 15B | −1.06 | −0.06 |
| 21A | −4.00 | 0.00 | $10^4$ | 21B | −3.30 | 0.70 |
| 21A | −3.00 | 0.00 | $10^3$ | 21B | −2.44 | 0.56 |
| 21A | −2.00 | 0.00 | $10^2$ | 21B | −1.54 | 0.46 |
| 21A | −1.00 | 0.00 | $10^1$ | 21B | −0.60 | 0.40 |
| 21A | 0.00 | 0.00 | $10^0$ | 21B | 0.34 | 0.34 |
| 22A | −3.44 | 0.56 | $10^4$ | 22B | −2.42 | 1.58 |
| 22A | −2.52 | 0.48 | $10^3$ | 22B | −1.84 | 1.16 |
| 22A | −1.60 | 0.40 | $10^2$ | 22B | −1.14 | 0.86 |
| 22A | −0.68 | 0.32 | $10^1$ | 22B | −0.36 | 0.64 |

This demonstrates the surprising reduced reciprocity law failure provides by photographic elements, compositions and processes of the invention. A so-called reciprocity curve and an explanation of reciprocity law failure, wherein the element is not treated with hydrogen, is set out in "The Theory of the Photographic Process," edited by C. E. Kenneth Mees and T. H. James, 3rd Edition, (1966), pages 132-144. The reciprocity law failure wherein the photographic element is not treated with hydrogen, as described herein, is significantly higher than an identical element which is treated with hydrogen.

EXAMPLE 23

A pure silver bromide emulsion and photographic element are prepared as described in Example 3. The element is evacuated under a pressure of about $10^{-3}$ torr for about 16 hours, then removed into room air, immersed in liquid nitrogen, allowed to equilibrate to liquid nitrogen temperature and subsequently exposed through a step tablet to light from a 500 watt tungsten lamp filtered through a Wratten No. 34 filter. Upon development for 12 minutes in a developer, as described in Example 1, 5 exposure steps (log E 0.2 increment) are visible and the image has a contrast (gamma) of 0.07. The speed and contrast are only slightly greater than those for a control element which is prepared, exposed and processed in the same manner with the exception that the control element is not evacuated.

A similar photographic element is prepared, evacuated, exposed and processed in the same manner as the control element with the exception that after evacuation the element is treated with hydrogen at 1 atmosphere pressure for 5 ⅔ hours before removal into room air. Fourteen steps are visible and the contrast (gamma) is 4.9.

EXAMPLE 24

The procedure set out in Example 23 is repeated with the exception that the element is evacuated for 2 minutes at a pressure of 25 torr. The resulting developing image has twelve visible steps and a gamma of 1.1.

EXAMPLES 25–27

The procedure set out in Example 14 is repeated in following Examples 25–27 with exposure with a Wratten 7 filter. Exposures are made in room air and in vacuum after hydrogen treatment. Exposures, which are for 100 seconds, are also made one hour after addition of room air to the hydrogen treated elements. Log relatively E points and relative speed are determined at a density of 0.6 above Dmin in each instance.

EXAMPLE 25

The photographic element treated comprises a medium contrast, medium speed photographic silver halide gelatino emulsion coated on a glass support. The silver halide contains about 9 mole percent iodide and the remainder bromide. It has a spectral sensitivity in the range of about 400 to about 650 nm with a maximum sensitivity between about 500 and 600 nm. Upon exposure for 100 seconds and processing, as described in Example 14, a control, i.e. not treated with hydrogen, is assigned a relative speed of 100. An identical element which is exposed and processed in the same way but which is treated with hydrogen, as described, has a relative speed of 180. Both elements are exposed in room air, not in vaccum.

EXAMPLE 26

The photographic element treated has a medium contrast photographic silver halide gelatino emulsion on a glass support. The silver halide contains about 9 mole percent iodide and the remainder bromide. It has a spectral sensitivity in the range of about 400 to about 700 nm. with a maximum sensitivity between about 550 and 650 nm. Upon exposure and processing, as described in Example 14, a control, i.e. not treated with hydrogen, is assigned a relative speed of 100. An identical element exposed and processed in the same way but which is subjected to vacuum and treated with hydrogen, as described, has a relative speed of 229. Both elements are exposed in room air, not in vacuum.

EXAMPLE 27

The photographic element treated has a high contrast photographic silver halide gelatino emulsion on a glass support. The silver halide contains about 9 mole percent iodide and the remainder bromide. It has a spectral sensitivity in the range of 480 to 680 nm. Exposure and processing are carried out as described in Example 14. A control element, which is not treated with hydrogen, is assigned a relative speed of 100. An identical element exposed and processed in the same manner, but which is subjected to vacuum and treated with hydrogen, has a relative speed of 209. Both elements are exposed in room air, not in vacuum.

EXAMPLE 28–30

The procedures set out in Example 14 are repeated in the following Examples 28–30, the exposure being with a Wratten 23 filter, described in Example 9, which provides a so-called wavelength cut off at 520 nm. This provides exposure of the element in the region to which the element has been spectrally sensitized. The treatment of the element is the same as in Examples 25–27 except that in Example 28, the photographic element is permitted to remain in room air for a longer period after hydrogen treatment and before exposure. Also in Examples 29 and 30 the element is permitted to stand in room air for one hour before exposure, rather than exposing the element in room air shortly after hydrogen treatment.

EXAMPLE 28

The photographic element employed in this example is the same as that employed in Example 25. It has a medium contrast, medium speed photographic silver halide gelatino emulsion on a glass support. The silver halide contains about 9 mole percent iodide and the remainder bromide. It has a spectral sensitivity of about 400 to about 650 nm. with a maximum sensitivity between about 500 and 600 nm. Upon exposure of the element for 100 seconds and processing, as described in Example 14, a control, i.e. not treated with hydrogen, is assigned a relative speed of 100. An identical element which is exposed and processed in the same way, but which is subjected to vacuum and treated with hydrogen, as described, has a relative speed of 177. In each of these cases, the element is permitted to stand in room air under atmospheric conditions for one hour before exposure.

When the procedure is repeated with the exceptions that exposure is for 1000 seconds and storage in room air before exposure is 51 hours, then the control element has a relative speed of 79 and the element treated with hydrogen has a relative speed of 190. This indicates that storage in room air in some instances before exposure and after hydrogen treatment surprisingly provides increased relative speed.

EXAMPLE 29

The photographic element employed in this example is the same as that employed in Example 26. The photographic element has a photographic silver halide gelatino emulsion on a glass support. The silver halide contains about 9 mole percent iodide and the remainder bromide. It has a spectral sensitivity of about 400 to about 700 nm. with a maximum sensitivity between about 550 and 650 nm. The element is exposed for 100 seconds and is processed, as described in Example 14, without hydrogen treatment. This is designated as a control and assigned a relative speed of 100. An identical element which is exposed and processed in the same way but which is subjected to vacuum and treated with hydrogen, as described, has a relative speed of 230. The element is stored in room air for one hour before exposure.

EXAMPLE 30

The photographic element employed in this example is the same as that employed in Example 27. The photographic element has a photographic silver halide gelatino emulsion on a glass support. The silver halide contains 9 mole percent iodide and the remainder bromide. It has high contrast and a spectral sensitivity between 480 and 680 nm. Upon exposure of the element for 100 seconds and processing, as described in Example 14, a control is assigned a relative speed of 100. An identical element which is exposed and processed in the same way but which is subjected to vacuum and treated with hydrogen has a relative speed of 203. This element is stored in room air under atmospheric conditions for one hour before exposure.

EXAMPLES 31–38

In each of Examples 31 through 38, the identified photographic element, prior to exposure, is placed in an apparatus which provides a vacuum (Fisher Model 48 vacuum oven) at room temperature, i.e. about 20°C., and evacuated to $1 \times 10^{-3}$ torr in about 4 hours and then held in the vacuum environment for 13 hours. The apparatus is then filled with hydrogen gas to a pressure of one atmosphere and held at this pressure for 4 hours. The photographic element is then removed from the apparatus and sensitometrically exposed for the times indicated in the table following Example 38 at an intensity required to give a density upon processing of 0.30 above minimum density. The photographic element is processed as described in each of the examples. In each instance, a significant increase in relative speed is observed compared to a control element which is prepared and processed in an identical manner but without hydrogen treatment.

EXAMPLE 31

This relates to a photographic element containing an internal sensitive photographic silver halide emulsion.

An internal image silver iodobromide emulsion, containing 2.5 mole % iodide, having an average grain size of 0.2 microns, is prepared by adding 106 mg. of potassium hexachloroiridate per mole of silver to the gelatin solution prior to precipitation of the silver halide. The resulting emulsion is coated on a film support at 100 mg. of silver per 929 square centimeters of support. The element is sensitometrically exposed through a step wedge and the resulting latent image is developed by immersing the photographic element in a developer having the following composition:

| | | | |
|---|---|---|---|
| 1-phenyl-3-pyrazolidone | | 10.0 | g. |
| sodium isoascorbate | | 40.0 | g. |
| sodium hydroxide | | 30.0 | g. |
| sodium sulfite | | 20.0 | g. |
| 1-phenyl-5-mercaptotetrazole | | 0.25 | g. |
| potassium bromide | | 5.0 | g. |
| potassium iodide | | 0.5 | g. |
| water | to | 1 | liter |

The element is fixed, washed with water and dried.

EXAMPLE 32

This relates to a photographic element which is a color reversal film.

A cellulose acetate film support is coated respectively with the following:

1. a red sensitive silver bromoiodide gelatin emulsion layer contaning a 50:50 parts by weight mixture of cyan color formers which are 5-[alpha-(2,4-di-tert-amylphenoxy-hexanamido]-2-heptafluorobutyramidophenol, described in U.S. Pat. No. 2,895,826 of Salminen, issued July 21, 1959 and 1-hydroxy-2-[Δ-(2,4-di-tert-amylphenoxy)-n-butyl]naphthamide, described in U.S. Pat. No. 2,474,293 of Weissberger at al., issued June 28, 1949,
2. gelatin interlayer,
3. a green sensitive silver bromoiodide gelatin emulsion layer containing a magenta color-forming coupler which is 1-(2,4,6-trichlorophenyl)-3-[3-{alpha-(2,4-di-tertamylphenoxy)acetamido}-benzamido]-5-pyrazalone, described in U.S. Pat. No. 2,600,788 of Loria et al., issued June 17, 1952,
4. yellow filter layer,
5. a blue sensitive silver bromoiodide gelatin emulsion layer containing a yellow color former alpha[3-{alpha-(2,4-di-tert-amylphenoxy)-butyramido}-benzoyl]-2-methoxy acetanilide, described in U.S. Pat. No. 2,875,057 of McCrossen et al., issued Feb. 24, 1959, and
6. a gelatin overcoat. The resulting photographic element is sensitometrically exposed and the latent image is developed in a reversal color process as follows:

| | Step* | Time | |
|---|---|---|---|
| 1. | Prehardener | 2 min., | 30 sec. |
| 2. | Neutralizer | | 30 sec. |
| 3. | First Developer | 3 min., | 30 sec. |
| 4. | First Stop Bath | | 30 sec. |
| 5. | Wash | | 30 sec. |
| 6. | Color Developer** | 3 min., | 30 sec. |
| 7. | Second Stop Bath | | 30 sec. |
| 8. | Wash | 1 min. | |
| 9. | Bleach | 1 min., | 30 sec. |
| 10. | Fixing Bath | 1 min., | 30 sec. |
| 11. | Wash | 1 min. | |

-continued

| | Step* | Time |
|---|---|---|
| 12. | Stabilizer | 30 sec. |
| 13. | Dry | |

*All steps are carried out at 38°C. with the exception of step 1 which is carried out at 35°C., step 6 which is carried out at 43°C. and step 13.
**No reversal exposure may be necessary. The reversal of the image may be accomplished chemically by inclusion of a reversal agent in the color developer (e.g. butyl amine borane, as given in the composition of the Color Developer below).

Chemicals and solutions used in the described steps of this process are as follows:

| | | |
|---|---|---|
| Prehardener | | |
| Water | 800.0 | ml |
| p-toluenesulfinic acid (sodium salt) | .5 | g |
| Sulfuric acid 18N | 5.41 | ml |
| Dimethoxytetrahydrofuran | 4.30 | ml |
| Sodium sulfate | 154.0 | g |
| Sodium Bromide | 2.0 | g |
| Sodium acetate | 20.0 | g |
| Formalin (37%, by volume, aqueous formaldehyde solution) | 27.9 | ml |
| N-methyl benzothiazolium-p-toluene sulfonate | .03 | g |
| Water to | 1.0 | liter |
| Neutralizer | | |
| Water | 800.0 | ml |
| Hydroxylamine Sulfate | 22.0 | g |
| Sodium Bromide | 17.0 | g |
| Glacial Acetic Acid | 10.0 | ml |
| Sodium Hydroxide | 6.0 | g |
| Sodium Sulfate | 50.0 | g |
| Water to | 1.0 | liter |
| First Developer | | |
| Water | 800.0 | ml |
| Sodium Tetraphosphate | 2.0 | g |
| Sodium Bisulfate | 8.0 | g |
| 1-phenyl-3-pyrazolidone | .35 | g |
| Sodium Sulfite | 37.0 | g |
| Hydroquinone | 5.5 | g |
| Sodium Carbonate (anhydrous) | 28.2 | g |
| Sodium Thiocyanate | 2.6 | g |
| Potassium Iodide (0.1%, by weight aqueous solution) | 6.0 | ml |
| Sodium Bromide | 1.30 | g |
| Water to | 1.0 | liter |
| First and Second Stop Bath | | |
| Water | 800.0 | ml |
| Glacial Acetic Acid | 30.0 | ml |
| Sodium Hydroxide | 1.75 | g |
| Water to | 1.0 | liter |
| Color Developer | | |
| Water | 800.0 | ml |
| Sodium Tetraphosphate | 5.0 | g |
| Benzyl Alcohol | 4.5 | g |
| Sodium sulfite | 7.5 | g |
| Trisodium phosphate . $12H_2O$ | 36.0 | g |
| Sodium Bromide | .30 | g |
| Potassium Iodide (0.1%, by weight aqueous solution) | 24.0 | ml |
| Sodium Hydroxide | 3.25 | g |
| Citrazinic Acid | 1.50 | g |
| 4-amino-3-methyl-N-ethyl-N-Beta-methanesulfonamido) ethylanaline sesquisulfate hydrate | 11.0 | g |
| Tertiary Butylamine Borane | .07 | g |
| Ethylenediamine | 3.0 | g |
| Water to | 1.0 | liter |
| Ferricyanide Bleach | | |
| Water | 800.0 | ml |
| Sodium bromide | 35.0 | g |
| Sodium ferricyanide (decahydrate) | 240.0 | g |
| Potassium persulfate | 67.0 | g |
| Borax ($Na_2B_4O_7.5H_2O$) | 1.0 | g |
| Sodium hydroxide | .10 | g |
| Water to | 1.0 | liter |
| Fixing Bath | | |
| Water | 800.0 | ml |
| Sodium thiosulfate (pentahydrate) | 200.0 | g |
| Sodium sulfite | 9.0 | g |
| Water to | 1.0 | liter |

-continued

| | | |
|---|---|---|
| Stabilizing Bath | | |
| Water | 800.0 | ml |
| Formalin | 12.0 | ml |
| Water to | 1.0 | liter |

EXAMPLE 33

This relates to a photographic element which is a high contrast black and white film. This is useful in the graphic arts as a so-called lith film.

A high contrast silver chlorobromoiodide gelatin emulsion is coated on a film support. The emulsion contains about 90 mole percent chloride, 9 mole percent bromide and 1 mole percent iodide to which is added a polyethylene glycol, as described in U.S. Pat. No. 3,294,537 of Milton, issued Dec. 27, 1966.

A gelatin overcoat is applied to the silver halide emulsion layer. The resulting photographic element is sensitometrically exposed through a step wedge having 0.3 log E increments. The latent image is developed by immersing the photographic element for four minutes in a developer having the following composition:

| | | |
|---|---|---|
| N-methyl-p-aminophenol sulfate | 2.0 | g. |
| sodium sulfite, desiccated | 90.0 | g. |
| hydroquinone | 8.0 | g. |
| sodium carbonate, monohydrate | 52.5 | g. |
| potassium bromide | 5.0 | g. |
| water to | 1.0 | liter |

The element is fixed, washed with water and dried.

EXAMPLE 34

This relates to a photographic element which is a color-print film.

A film support is coated respectively with the following:

1. a blue sensitive silver chlorobromide gelatin emulsion containing alpha-pivalyl-alpha-(4-carboxyphenoxy)-2-chloro-5-[gamma-(2,4-di-tert-amylphenoxy)-butyramido]-acetanilide, as described in U.S. Pat. No. 3,408,194 of Loria, issued Oct. 29, 1968,
2. gelatin interlayer,
3. a red sensitive silver chlorobromide gelatino emulsion containing the cyan color former 2-[alpha-(2,4di-tert-amylphenoxy)-butyramido]-4,6-dichloro-5-methylphenol, as described in U.S. Pat. No. 2,423,730 of Salminen et al., issued, July 8, 1947 and U.S. Pat. No. 2,801,171 of Fierke et al., issued July 30, 1957,
4. gelatin interlayer,
5. a green sensitive silver chlorobromide gelatino emulsion containing the magenta color former 1-(2,4-dimethyl-6-chlorophenyl)-3-[3-n-pentadecylphenoxy)-butyramido]-5-pyrazolone, and
6. a gelatin overcoat. The resulting photographic element is sensitometrically exposed and the latent image is developed in a color-print process as follows:

| | |
|---|---|
| 1. Prebath | 15 sec. |
| 2. Wash | 15 sec. |
| 3. Color develop | 9 min. |
| 4. Stop bath | 2 min. |
| 5. Wash | 1 min. |
| 6. Bleach-fix | 2 min. |
| 7. Wash | 6 min. |
| 8. Stabilize | 10 sec. |

-continued

| | | |
|---|---|---|
| 9. Dry | | |
| Process temperature | 24°C | |

The composition of the above baths is as follows:

| | | |
|---|---|---|
| 1. Prebath | | |
| Borax ($Na_2B_4O_7.10H_2O$) | 20 | g |
| Sodium sulfate, desiccated | 100 | g |
| Sodium hydroxide, 10% solution | 10 | g |
| Water to make | 1 | liter |
| 3. Color Developer | | |
| Sodium hexametaphosphate | 2 | g |
| Sodium sulfide, desiccated | 4 | g |
| 2-Amino-5-diethylaminotoluene, monohydrochloride | 3 | g |
| Sodium carbonate, monohydrated | 20 | g |
| Potassium bromide | 2 | g |
| Water to make | 1 | liter |
| 4. Stop Bath | | |
| Acetic acid, glacial | 17 | ml |
| Sodium acetate (anhydrous) | 2.94 | g |
| Water to make | 1 | liter |
| 6. Bleach-fix | | |
| Hydrochloric acid, conc. | 9.2 | ml |
| Sodium sulfite | 12 | g |
| Ammonium iron salt of ethylenediamine tetracetic acid (0.48 molar solution) | 92 | ml |
| Ammonium thiosulfate (60% by weight solution) | 200 | ml |
| Water to make | 1 | liter |
| 8. Stabilizing Bath | | |
| Formaldehyde (37%w solution) | 20 | ml |
| Surfactant (Kodak Photo-Flo, available from Eastman Kodak Co., U.S.A.) | 2 | ml |
| Water to make | 1 | liter |

EXAMPLE 35

This relates to a photographic element which is a color negative film.

A color negative film is prepared by coating a film support with the following:

1. two layers of red sensitive silver halide gelatino emulsion containing the cyan color former 1-hydroxy-2-[Δ(2,4-di-tert-amylphenoxyl)-n-butyl]-naphthamide, as described in U.S. Pat. No. 2,474,293 of Weissberger et al., issued June 28, 1949, 2. gelatin interlayer, 3. two layers of green sensitive silver halide gelatino emulsion containing the magenta color former 1-(2,4,6-trichlorophenyl-3-[3-alpha-(2,4-di-tert-amylphenoxy) acetamido-benzamido]-5-pyrazolone, as described in U.S. Pat. No. 2,600,788 of Loria et al., issued June 17, 1952, 4. a yellow filter layer, 5. a blue sensitive silver halide gelatino emulsion containing the yellow color former [3-(2,4-di-tert-amylphenoxy)-butyramidobenzoyl]-2-methoxyacetanilide, as described in U.S. Pat. No. 2,875,057 of McCrossen et al., issued Feb. 24, 1959, and 6. a gelatin overcoat. The resulting element is sensitometrically exposed and the resulting latent image is developed in the following process:

| | |
|---|---|
| 1. Color developer | 7 min., 30 sec. |
| 2. Wash | 15 sec. |
| 3. Acid stop bath | 2 min. |
| 4. Bleach-fix | 4 min. |
| 5. Bleach | 4 min. |
| 6. Wash | 7 min. |
| 7. Buffer | 1 min. |

-continued

| | |
|---|---|
| 8. Wash | 2 sec. |
| 9. Dry | |

*Each step is carried out at 21°C.

The processing solutions have the following compositions:

| | |
|---|---|
| Color Developer | |
| Water | 950.0 ml |
| Benzyl alcohol | 3.8 ml |
| Sodium sulfite | 2.1 g |
| Sodium hydroxide | 0.45 g |
| 4-amino-N-ethyl-(β-methanesulfonamidoethyl)-meta-toluidine sesquisulfate monohydrate | 5.0 g |
| Sodium bromide | 0.86 g |
| Sodium carbonate (anhydrous) | 42.7 g |
| Water to make | 1.0 liter |
| pH 10.75 at 21°C. | |
| Fix Bath | |
| Water | 600.0 ml |
| Sodium thiosulfate | 240.0 g |
| Sodium sulfite | 15.0 g |
| Glacial acetic acid | 13.4 g |
| Boric acid | 7.5 g |
| Potassium alum | 15.0 g |
| Water to make | 1.0 liter |
| pH 4.2 at 21°C. | |
| Bleach Bath | |
| Water | 800.0 ml |
| Potassium ferricyanide | 50.0 g |
| Potassium bromide | 20.0 g |
| Water to make | 1.0 liter |
| pH 6.5 at 21°C. | |
| Buffer Bath | |
| Water | 800.0 ml |
| Disodium hydrogen phosphate | 8.2 g |
| Glacial acetic acid | 4.5 ml |
| Water to make | 1.0 liter |
| pH 5.0 at 21°C. | |
| Acid Stop Bath | |
| Water | 600.0 ml |
| Sodium sulfite | 15.0 g |
| Glacial acetic acid | 15.0 ml |
| Water to make | 1.0 liter |

Adjustment to final pH of 4.2 using acetic acid or sodium hydroxide as required.

| | |
|---|---|
| Bleach-Fix Bath | |
| Ferric chloride ($6H_2O$) | 24.0 g |
| Ethylenediamine tetraacetic acid tetrasodium salt | 40.0 g |
| Sodium thiosulfate ($5H_2O$) | 150.0 g |
| Sodium sulfite | 15.0 g |
| pH at 7.0 at 21°C. | |

EXAMPLE 36

This relates to a so-called intermediate color film.

A photographic element is prepared by coating a film support, respectively with the following:

1. a red sensitive silver iodobromide gelatino emulsion containing the cyan color former 1-hydroxy-2-[(2,4-di-tert-amylphenoxy)-n-butyl]-naphthamide, as described in U.S. Pat. No. 2,474,293 of Weissberger et al., issued June 28, 1949, 2. gelatin interlayer, 3. a green sensitive silver iodobromide gelatino emulsion containing the magenta color former 1-(2,4,6-trichlorophenyl)-3-benzamido-5-pyrazolone, as described in U.S. Pat. No. 3,342,596 of Graham, issued Sept. 19, 1967, 4. a yellow filter layer, 5. a blue sensitive silver iodobromide gelatino emulsion containing the yellow color former [3-(2,4-di-tert-amylphenoxy)-butyramidophenylbenzoyl]-2-methoxy acetanilide, as described in U.S. Pat. No. 2,875,057 of McCrossen et al., issued Feb. 24, 1959, and 6. a gelatin overcoat.

The resulting photographic element is sensitometrically exposed and the latent image is developed in the following process:

| Step* | Time |
|---|---|
| 1. Color Developer | |
| 2. Stop Bath | 2 min. |
| 3. Fix | 2 min. |
| 4. Wash | 2 min. |
| 5. Bleach | 4 min. |
| 6. Wash | 2 min. |
| 7. Hardener-Fixer | 2 min. |
| 8. Wash | 8 min. |
| 9. Hardener | 3 min. |
| 10. Wash | 2 min. |
| 11. Buffer | 3 min. |
| 12. Dry | |

*The process is carried out at 23°C. to 25°C.

The following processing solutions are employed for this process:

| | | |
|---|---|---|
| 1. Color Developer | | |
| Water | 1.0 | liter |
| Benzyl alcohol | 12.6 | cc |
| Sodium hexametaphosphate (Calgon) | 2.0 | grams |
| Sodium sulfite, anhydrous | 2.1 | grams |
| Sodium carbonate monohydrate | 26.8 | grams |
| Sodium bicarbonate | 2.9 | grams |
| Potassium bromide | 0.48 | grams |
| Sodium chloride | 0.7 | grams |
| Hydroxylamine sulfate | 2.1 | grams |
| Color developer* | 9.96 | grams |

*4-amino-N-ethyl-N-(β-methanesulfonamidoethyl)-m-toluidine sesquisulfate monohydrate.

| | | |
|---|---|---|
| 2. Stop Bath | | |
| Water | 1.0 | liter |
| Glacial acetic acid | 17.0 | cc |
| Sodium sulfite, anhydrous | 20.0 | grams |
| 3. Fix | | |
| Water | 1.0 | liter |
| Sodium thiosulfate | 223 | grams |
| Sodium bisulfite | 12.0 | grams |
| Sodium acetate, anhydrous | 14.0 | grams |
| Sodium citrate | 1.7 | grams |
| Boric acid | 5.0 | grams |
| Potassium alum, granular | 24.0 | grams |
| 5. Bleach | | |
| Water | 1.0 | liter |
| Sodium nitrate | 45.0 | grams |
| Potassium ferricyanide | 22.5 | grams |
| Potassium bromide | 8.2 | grams |
| Boric acid | 7.5 | grams |
| Borax | 0.97 | grams |
| 7. Hardener-Fixer | | |
| Water | 1.0 | liter |
| Glacial acetic acid | 15 | cc |
| Sodium zirconyl sulfate (Zircontan-N) | 0.46 | grams |
| Sodium bisulfite | 17.9 | grams |
| Sodium thiosulfate | 167.7 | grams |
| Sodium citrate | 2.5 | grams |
| Boric acid | 7.2 | grams |
| Potassium alum, granular | 35.5 | grams |
| Sodium hydroxide, granular | 10.4 | grams |
| Zinc sulfate monohydrate | 7.5 | grams |
| 9. Hardener | | |
| Water | 1.0 | liter |
| Sodium hexametaphosphate | 0.75 | grams |
| Sodium carbonate monohydrate | 8.8 | grams |
| Formaldehyde (37% by weight) | 25.5 | cc |

-continued

| | | |
|---|---|---|
| 11. Buffer | | |
| Water | 1.0 | liter |
| Citric acid | 30.0 | grams |
| Borax | 20.4 | grams |

EXAMPLE 37

This relates to a high contrast black and white film. An antihalation layer is coated on a film support. The antihalation layer is coated on the support at 4.6 grams per 929 square centimeters of support. The antihalation composition contains 4.54 grams of gelatin, 0.91 grams of poly(alpha-methyl allyl-n-quanidylketimine), 0.153 grams of saponin and 0.302 grams of 4-[(3-ethyl-2(3H)-benzoxazolylidene) ethylidene]-3-methyl-1-(p-sulfophenyl)-2-pyrazolin-5-one, monosulfonated:

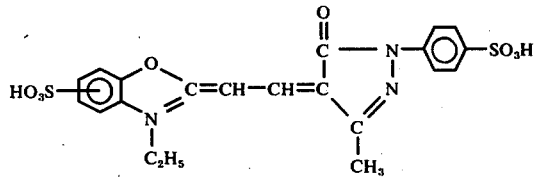

which is a so-called blue absorber, and water to provide a total weight of 150 grams. The antihalation layer is then overcoated with a silver iodobromide panchromatically sensitized gelatino emulsion at a thickness of 0.2 microns. Over the emulsion layer is coated a protective gelatin layer. The resulting photographic element is sensitometrically exposed through a step wedge having 0.3 log E increments. The latent image is developed by immersing the element for 6 minutes in a developer which has the following composition:

| | | | |
|---|---|---|---|
| N-methyl-p-amino phenol, sulfate | | 2.0 | g. |
| sodium sulfite, desiccated | | 90.0 | g. |
| hydroquinone | | 8.0 | g. |
| sodium carbonate, monohydrated | | 52.5 | g. |
| potassium bromide | | 5.0 | g. |
| water | to | 1 | liter |

The image is fixed in a fixing bath having the following composition:

| | | | |
|---|---|---|---|
| sodium thiosulfate | | 240.0 | g. |
| sodium sulfite, dessicated | | 15.0 | g. |
| acetic acid (28% by volume) | | 48.0 | g. |
| volu | | | |
| boric acid, crystals | | 7.5 | g. |
| potassium alum | | 15.0 | g. |
| water | to | 1 | liter |

EXAMPLE 38

This relates to a film which is a photographic silver halide film which has a photographic silver halide emulsion on each side of the film support.

This film is prepared by coating on each side of a film support a large grain silver iodobromide orthochromatic sensitized gelatino emulsion at 430 mg. of silver for each 929 square centimeters of support. Over each emulsion layer is coated a protective gelatin layer. The resulting photographic element is sensitometrically exposed on each side as described in Example 37 and processed as described in that example.

| Example No. and Photographic Element | A | | B | | C | |
|---|---|---|---|---|---|---|
| | Log of Relative Intensity* | Exposure Time in Seconds | Log of Relative Intensity* | Exposure Time in Seconds | Log of Relative Intensity* | Exposure Time in Seconds |
| 31. Internal Sensitive Emulsion | | | | | | |
| Control | .9 | 1000 | 3.0 | 10 | 5.0 | 1/10 |
| Invention | .6 | 1000 | 2.7 | 10 | 4.7 | 1/10 |
| 32. Color Reversal Film | | | | | | |
| Red Control | 1.55 | 1000 | 2.1 | 100 | 4.3 | 1/10 |
| Red-Invention | 1.0 | 1000 | 1.8 | 100 | 4.2 | 1/10 |
| Green Control | 1.1 | 1000 | 1.85 | 100 | 4.1 | 1/10 |
| Green-Invention | 0.7 | 1000 | 1.55 | 100 | 4.1 | 1/10 |
| Blue Control | 1.4 | 1000 | 1.95 | 100 | 3.9 | 1/10 |
| Blue-Invention | 0.5 | 1000 | 1.45 | 100 | 3.75 | 1/10 |
| 33. Lith Film | | | | | | |
| Control | 0.9 | 100 | 1.75 | 10 | 3.6 | 1/10 |
| Invention | 0.55 | 100 | 1.6 | 10 | 3.6 | 1/10 |
| 34. Color Print Film | | | | | | |
| Blue Control | 1.55 | 1000 | 3.45 | 1 | 4.25 | 1/10 |
| Blue-Invention | 1.1 | 1000 | 3.30 | 1 | 4.1 | 1/10 |
| Green Control | 1.55 | 1000 | 3.80 | 1 | 4.6 | 1/10 |
| Green-Invention | 1.4 | 1000 | 3.70 | 1 | 4.55 | 1/10 |
| Red Control | 2.15 | 1000 | 4.2 | 1 | 5.1 | 1/10 |
| Red-Invention | 2.0 | 1000 | 4.15 | 1 | 5.05 | 1/10 |
| 35. Color Negative Film | | | | | | |
| Red Control | 0.5 | 1000 | 1.8 | 10 | 3.3 | 1/10 |
| Red-Invention | 0.0 | 1000 | 1.5 | 10 | 3.5 | 1/10 |
| Green Control | 0.6 | 1000 | 1.95 | 10 | 3.45 | 1/10 |
| Green-Invention | 0.25 | 1000 | 1.8 | 10 | 3.3 | 1/10 |
| Blue Control | 0.15 | 1000 | 1.95 | 10 | 3.35 | 1/10 |
| Blue-Invention | −0.2 | 1000 | 1.8 | 10 | 3.35 | 1/10 |
| 36. Intermediate Color Film | | | | | | |
| Red Control | 3.7 | 10 | 4.5 | 1 | 5.5 | 1/10 |
| Red-Invention | 3.55 | 10 | 4.4 | 1 | 5.35 | 1/10 |
| Green Control | 3.7 | 10 | 4.65 | 1 | 5.6 | 1/10 |
| Green-Invention | 3.6 | 10 | 4.55 | 1 | 5.5 | 1/10 |
| Blue Control | 3.6 | 10 | 4.4 | 1 | 5.3 | 1/10 |
| Blue-Invention | 2.9 | 10 | 4.0 | 1 | 4.9 | 1/10 |
| 37. High Contrast Film | | | | | | |
| Control | 2.0 | 100 | 2.80 | 10 | 4.1 | 1/10 |
| Invention | 1.4 | 100 | 2.55 | 10 | 4.0 | 1/10 |
| 38. Duplitized Film | | | | | | |
| Control | 1.2 | 10 | 2.1 | 1 | 3.0 | 1/10 |
| Invention | 1.0 | 10 | 1.95 | 1 | 2.8 | 1/10 |

*Intensity required to give a density of 0.30 above $D_{min}$.

EXAMPLE 39

A silver iodobromide gelatino emulsion, containing about 6 mole percent iodide, is chemically sensitized with potassium chloroaurate N,N-dimethylselenourea and sodium thiosulfate. The emulsion is panchromatically sensitized and coated on a film support. A protective gelatin overcoat is coated on the resulting emulsion layer to provide a photographic element. This photographic element, after coating and prior to exposure, is placed in a vacuum oven at room temperature, i.e. about 20°C, which is evacuated to $1 \times 10^{-3}$ torr in about 4 hours. The photographic element is held in the vacuum environment for 13 hours. The vacuum oven is then filled with hydrogen gas to a pressure of one atmosphere and then held in the hydrogen atmosphere at one atmosphere pressure for 4 hours. The photographic element is then removed from the vacuum oven and sensitometrically exposed to tungsten light for one second through a step wedge having 0.3 log E increments. The resulting latent image is developed by immersing the photographic element for 6 minutes at 20°C in the developer solution described in Example 1. The photographic element is then immersed in a fixing solution as described in Example 1 for four minutes, washed with water and dried. The relative photographic speed of the resulting photographic element is 159 compared to a relative speed of 100 for a control photographic element which is prepared, exposed and processed in the same manner but without the described hydrogen treatment.

EXAMPLE 40

A fine grain silver bromide gelatino emulsion is chemically sensitized with a sulfur sensitizer and coated on a film support at 540 mg of silver per 929 square centimeters of support. The resulting photographic element, after coating and before exposure, is placed in a vacuum oven at room temperature, i.e. about 20°C, which is evacuated to $1 \times 10^{-1}$ torr in about 1 hour. The photographic element is held in the vacuum environment for 16 hours. The vacuum oven is then filled with hydrogen gas to a pressure of one atmosphere. The photographic element is held in the hydrogen atmosphere for two hours after which it is removed from the hydrogen atmosphere and sensitometrically exposed to tungsten light for 100 seconds through a step wedge having 0.3 log E increments. The resulting latent image is developed, fixed, washed and dried employing the procedure and processing solutions described in Example 39. The observed relative photographic speed for the resulting element is 562. The relative photographic speed for a control photographic element which is prepared, exposed and processed in the same manner, but without hydrogen treatment is 100.

EXAMPLE 41

The procedure set out in Example 39 is repeated with the exception that after evacuation of the vacuum sensitometer, it is filled with a mixture of equal parts by volume of hydrogen and helium. The resulting photographic element has a relative speed of 126 compared to a relative speed of 100 for a control photographic element which is prepared, exposed, and processed in the same manner but without the described treatment with a mixture of hydrogen with helium.

EXAMPLE 42

A paper support is coated with 150 mg per 929 square centimeters of support of titanium dioxide and 300 mg of copolymer of ethylacrylate with acrylic acid per 929 square centimeters of support. The resulting element is treated with hydrogen as described in Example 39. The resulting element is sensitometrically exposed to a xenon lamp for 20 minutes and then dipped in an aqueous solution of silver nitrate. It is then rinsed with water and dipped in a silver thiosulfateascorbic acid physical developer until an image is developed. The physical developer is prepared by mixing the following parts A and B in equal parts by volume:

| | |
|---|---|
| Part A | |
| water | 800.0 cc |
| sodium sulfite | 20.0 g |
| sodium isoascorbate | 20.0 g |
| sodium carbonate | 50.0 g |
| surfactant (octyl phenoxy ethoxy ethyl dimethyl p-chlorobenzyl ammonium chloride) (1% by weight in water) | 20.0 cc |
| water to | 1 liter |
| pH 11.0 | |
| Part B | |
| water | 800.0 cc |
| sodium thiosulfate | 30.0 g |
| silver chloride | $5 \times 10^{-2}$ moles |
| 5-methylbenzotriazole (1% by weight in dilute aqueous potassium hydroxide solution) | 40.0 cc |
| water to | 1 liter |

Relative photographic speed, measured at 0.1 density units above fog, for the resulting element is 178 compared to 100 for a control element which is prepared, exposed and processed in the same manner but without the described hydrogen treatment.

EXAMPLE 43

A series of polymer-peptized, fine-grain (0.2 micron cubes) silver iodobromide emulsions, both with and without chemical sensitization as indicated below in the Table are coated on cellulose acetate film supports at 60 mg of silver/ft$^2$ and 125 mg of colloid, as identified below in the Table, per square foot of film surface.

Six of the elements are placed in a closed chamber. Hydrogen gas is flowed into one end of the chamber while at the same time air was permitted to flow out of the opposite end of the chamber. The chamber is sealed and the hydrogen atmosphere (1 atmosphere) is maintained for 6 hours at 15°C.

Following hydrogen treatment the six elements retained in the chamber and a vacuum is applied at a pressure of $10^{-5}$ torr. This pressure is maintained for 15 hours at 15°C. Thereafter these six elements are subjected to photographic testing as described below.

Six other elements were placed into the chamber which is sealed. Vacuum is applied until a pressure of $10^{-5}$ torr is obtained. This pressure was maintained for 15 hours at 15°C. Following this vacuum treatment these six elements are subjected to photographic testing as described below.

The remaining six elements, which had no vacuum or hydrogen treatments, along with the 12 elements treated in accordance with the above descriptions, were each exposed for 1000 seconds to a 1000-watt quartz-iodine lamp operated at 8 amps. The light source was located 82 cm from the film plane and was filtered through a Wratten 7 filter and an infrared filter. Two ground glass diffusers were placed in the light beam in order to obtain even distribution of the light over the photographic elements. Following exposure the elements were developed for 10 minutes at 20°C using the developer solution described above in Example 1. Thereafter, the elements were immersed in the fixing solution described in Example 1 for 5 minutes at 20°C.

After washing and drying log relative E points and relative speed data were read at a density of 0.5 for all 18 elements. Resulting photographic data are shown in the Table.

| Coating Element | Colloid Used | Chemical Sensitization | Hydrogen Treatment | Vacuum Treatment | Relative Speed |
|---|---|---|---|---|---|
| 1 | gelatin | none | no | no | 100 |
| 2 | gelatin | none | no | yes | 16,950 |
| 3 | gelatin | none | yes | yes | 97,500 |
| 4 | (1) | none | no | no | 100 |
| 5 | (1) | none | no | yes | 616 |
| 6 | (1) | none | yes | yes | 2,950 |
| 7 | (1) | none | no | no | 100 |
| 8 | (1) | none | no | yes | 480 |
| 9 | (1) | none | yes | yes | 4,270 |
| 10 | gelatin | $Na_2S_2O_3$/ $KAuCl_4$ | no | no | 100 |
| 11 | gelatin | $Na_2S_2O_3$/ $KAuCl_4$ | no | yes | 1,260 |
| 12 | gelatin | $Na_2S_2O_3$/ $KAuCl_4$ | yes | yes | 14,350 |
| 13 | (1) (1) | $Na_2S_2O_3$/ $KAuCl_4$ | no | no | 100 |
| 14 | (1) | $Na_2S_2O_3$/ $KAuCl_4$ | no | yes | 436 |
| 15 | (1) | $Na_2S_2O_3$/ $KAuCl_4$ | yes | yes | 11,250 |
| 16 | (1) | $Na_2S_2O_3$/ $KAuCl_4$ | no | no | 100 |
| 17 | (1) | $Na_2S_2O_3$/ $KAuCl_4$ | no | yes | 616 |
| 18 | (1) | $Na_2S_2O_3$/ | yes | yes | 5,490 |

-continued

| Coating Element | Colloid Used | Chemical Sensitization | Hydrogen Treatment | Vacuum Treatment | Relative Speed |
|---|---|---|---|---|---|
| | | $KAuCl_4$ | | | |

(1) Colloid composed of polymer derived from 1 part of (3-thiopental)acrylate to 6 parts of 3-acryloxy propane-1-sulfonic acid, sodium salt.

EXAMPLE 44

A silver behenate-behenic acid dispersion is prepared by mixing the following components:

| | |
|---|---|
| Silver Behenate | 42.0 g |
| Behenic Acid | 32.0 g |
| Poly(vinyl butyral) | 15.0 g |
| Phthalimide | 8.5 g |

and ball-milling for 72 hours. A photosensitive composition is prepared by adding the following solution. Silver bromide is formed in-situ.

| | |
|---|---|
| Acetone solution containing 1% by weight lithium bromide | 75.0 ml |
| Acetone-toluene (1:1 by volume) | 500.0 ml |

A final coating mixture is prepared by combining 213 ml of the above photosensitive dispersion with the following solutions:

| | |
|---|---|
| Acetone solution containing 0.07% by weight 3-carboxy-methyl-5-[(3-methyl-2(3H)-thiazolinylidene)-iso-propylidene]rhodanine | 2.4 ml |
| Acetone solution containing 10% by weight 2,2'-dihydroxy-1,1'-binaphthyl | 50.0 ml |
| Acetone-toluene (1:1 by volume) | 46.0 ml |

The final composition is stirred thoroughly, coated on a polyethylene coated paper support at 5.2 g composition/ft$^2$ and dried, thereby providing a photosensitive and thermosensitive element containing 60 mg of silver/ft$^2$.

A sample of the above element was kept under room air conditions at 20°C and thereafter exposed for 100 seconds and then heat processed by holding the back side of the element in contact with a heating block for 6 seconds at 130°C.

Another sample of the same element was placed into a cylinder which was evacuated to $5 \times 10^{-2}$ torr for 1 hour, at a temperature of 20°C. Thereafter the cylinder was filled with hydrogen gas and held for 1 hour at 20°C and at 1 atmosphere of hydrogen pressure before opening into a nitrogen-flushed dry box. The sample was removed, exposed for 100 seconds and then heat processed as above in a nitrogen atmosphere. Results of these two runs are shown below.

| | Relative Speed | Gamma | $D_{min}$ | $D_{max}$ |
|---|---|---|---|---|
| Room Air | 100 | 0.71 | 0.16 | 0.77 |

-continued

| | Relative Speed | Gamma | $D_{min}$ | $D_{max}$ |
|---|---|---|---|---|
| Vacuum + Hydrogen | 1380 | 2.54 | 0.12 | 1.36 |

The above results show that large gains in photosensitivity can be obtained by vacuum plus hydrogen sensitization of photothermographic elements.

EXAMPLE 45

Three fine grain direct positive silver bromoiodide emulsions are coated on an acetate base at a coverage of 360 mg Ag/ft$^2$ and 720 mg gelatin/ft$^2$. The first emulsion layer is deliberately not chemically sensitized, the second is reduction sensitized and the third is sulfur sensitized. Reciprocity exposures are obtained by making blue light exposures through a step tablet with a 1000-watt quartz-iodine lamp. The light intensity is modulated using calibrated neutral density filters. The surface image of the exposed film is developed for 10 min. at 20°C in the presence of a solution of N-methyl-p-aminophenol sulfate (2.5 g), ascorbic acid (10 g), Kodalk (35.0 g), potassium bromide (1.0 g) and water to make 1 liter. The internal image is developed for 20 minutes using the same developer with 3.0 g/liter of sodium thiosulfate added. Prior to internal development the surface image is bleached for 5 minutes using a solution of potassium ferricyanide (3 g), 1M acetic acid (25 cc), sufficient NaOH to adjust the pH to 5 and water to make 1 liter. The reciprocity curves are plotted at a density of 0.4 above fog for exposures from 0.9 seconds to 3000 seconds. The materials which are treated in accordance with the invention obtained a straight line thereby evidencing substantially no reciprocity failure. The other emulsions did not yield a straight line. Exposures were made in room air without vacuum and/or hydrogen treatment, in vacuum after 16 hours of evacuation at $10^{-6}$ torr and in vacuum after 16 hours of evacuation at $10^{-6}$ torr and 4 hours of treatment with dry hydrogen at 1 atmosphere pressure and room temperature. Substantial increases in sensitivity with the hydrogen treatment are observed for all three emulsions over the entire intensity range both for the internal latent image and surface latent image. The relative speed for internal latent image formation by a 1000 second exposure of the emulsion layer with no deliberate chemical sensitization is 100 in air, 400 after vacuum treatment only and 517 after vacuum and hydrogen treatment; those for the sulfur sensitized emulsion coating are 100 in room air, 296 after vacuum treatment only and 705 after vacuum and hydrogen treatment. Those for the reduction sensitized emulsion coatings are 100 in air, 148 after vacuum treatment and 215 after hydrogen and vacuum treatment.

The invention has been described in detail with particular reference to preferred embodiments thereof, but it will be understood that variations and modifications can be effected within the spirit and scope of the invention.

We claim:

1. A process for increasing the sensitivity of a solid negative-forming radiation-sensitive gelatino-silver halide emulsion containing layer which process comprises substantially reducing the concentrations of atmospheric gases and moisture in said layer and thereafter treating said layer with a gaseous atmosphere at a pressure of from about 0.5 atmosphere to about 10 atmospheres containing at least about 10 volume percent of hydrogen until the sensitivity of said layer is increased.

2. A process according to claim 1 wherein the concentration of atmospheric gases and moisture is reduced by subjecting said layer to vacuum treatment.

3. A process according to claim 2 wherein the vacuum is from less than about atmospheric pressure to about $10^{-7}$ torr.

4. A process according to claim 1 wherein the hydrogen treatment is performed at from about 0.8 atmospheres to about 1 atmosphere.

5. A process according to claim 1 wherein the hydrogen treatment is maintained from about 30 seconds to about 3 weeks.

6. A process according to claim 1 wherein the hydrogen treatment is maintained from about 1 minute to about 24 hours.

7. A process according to claim 1 wherein the treatment is maintained from about 15 minutes to about 6 hours.

8. A process according to claim 7 wherein the hydrogen treatment is maintained for 4 hours from about 0.8 atmospheres to about 1 atmosphere.

9. A process according to claim 3 wherein the vacuum is maintained from about $10^{-3}$ torr to about $10^{-7}$ torr.

10. A process according to claim 1 wherein the hydrogen treatment is performed at a temperature from about 0°C to about 100°C.

11. A process according to claim 1 wherein said silver halide emulsion is chemically sensitized.

12. A process according to claim 1 wherein said silver halide emulsion is spectrally sensitized.

13. A process according to claim 11 wherein said silver halide emulsion is also spectrally sensitized.

14. A solid negative-forming radiation sensitive silver halide layer treated in accordance with the process of claim 1; said layer having a substantially constant density when exposed to the same quanta of radiation over a range of from $10^0$ to about $10^4$ seconds and developed, said quanta of radiation being the amount needed to yield a density in the developed silver halide layer of about 0.4 above fog; the sensitivity of said layer being substantially increased by storage for about 30 days after imagewise exposure but before development of said layer.

15. A radiation sensitive layer according to claim 14 coated on a photographic film support.

16. A radiation sensitive silver halide emulsion according to claim 14, said emulsion being chemically sensitized.

17. A radiation sensitive emulsion according to claim 14, said emulsion being spectrally sensitized.

18. A radiation sensitive emulsion according to claim 16, said emulsion also being spectrally sensitized.

19. A radiation sensitive emulsion according to claim 16, said emulsion being chemically sensitized with sulfur and gold.

20. A radiation sensitive emulsion according to claim 16, said emulsion being chemically sensitized with selenium and gold.

21. A radiation sensitive emulsion according to claim 14 wherein said silver halide is silver bromoiodide.

22. A radiation sensitive silver halide emulsion according to claim 14 said emulsion containing a photographic color coupler.

23. A radiation sensitive silver halide emulsion according to claim 22 wherein said photographic color coupler is a phenolic coupler, a 5-pyrazolone coupler or an open chain ketomethylene coupler.

24. A photographic element comprising a support and a radiation sensitive silver halide layer treated in accordance with the process of claim 1.

25. A process according to claim 11, said emulsion being sensitized with sulfur and gold.

26. A process according to claim 11, said emulsion being sensitized with selenium and gold.

27. A solid photographic element treated in accordance with the process of claim 9; said photographic element comprising at least one negative-forming radiation sensitive silver halide layer coated on a photographic support, said element having substantially no reciprocity failure when exposed to the same quanta of radiation over a range of from about 1 to about 3000 seconds and exhibiting increased sensitivity upon prolonged storage after imagewise exposure but before development, said quanta being that amount of radiation necessary to produce in said element a density of 0.4 above fog.

* * * * *